US010502533B2

(12) United States Patent
Osienski et al.

(10) Patent No.: US 10,502,533 B2
(45) **Date of Patent: *Dec. 10, 2019**

(54) MARINE BARRIER SYSTEMS

(71) Applicant: Halo Maritime Defense Systems, Inc., Newton, NH (US)

(72) Inventors: Michael J. Osienski, Londonderry, NH (US); Judson DeCew, Rochester, NH (US); Tom Sherwin, Newton, NH (US); Eric H. Rines, Manchester, NH (US); Sean Gribbin, Newton, NH (US)

(73) Assignee: HALO MARITIME DEFENSE SYSTEMS, INC., Newton, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/246,680

(22) Filed: Jan. 14, 2019

(65) Prior Publication Data

US 2019/0145743 A1 May 16, 2019

Related U.S. Application Data

(63) Continuation-in-part of application No. 15/712,220, filed on Sep. 22, 2017, now Pat. No. 10,215,540.
(Continued)

(51) Int. Cl.
*F41H 11/05* (2006.01)
*E02B 3/04* (2006.01)
(Continued)

(52) U.S. Cl.
CPC ..... *F41H 11/05* (2013.01); *E02B 3/04* (2013.01); *E02B 3/20* (2013.01); *E02B 15/0807* (2013.01); *E02B 15/08* (2013.01)

(58) Field of Classification Search
CPC combination set(s) only.
See application file for complete search history.

(56) References Cited

U.S. PATENT DOCUMENTS 3,537,587 A 11/1970 Kain
4,136,994 A 1/1979 Fuller
(Continued)

FOREIGN PATENT DOCUMENTS

WO 2016/005970 A1 1/2016

OTHER PUBLICATIONS

PCT International Search Report and Written Opinion dated Nov. 22, 2017 for related International Application No. PCT/US17/52880.

*Primary Examiner* — Kyle Armstrong
(74) *Attorney, Agent, or Firm* — Miles & Stockbridge P.C.; Michael A. Messina

(57) ABSTRACT

A marine barrier system is provided with two elongate buoyant members, a net support member between and above the two buoyant members, an elongate load bearing member spaced from and between the buoyant members, and a lower ballast member between the two buoyant members and below the buoyant members. Stanchions extend between the members to support them and maintain the spacing between them. An impact net is attached to the net support member and the load bearing member. When a moving vessel impacts the impact net, the net deflects to transfer a force of the impact to the net support member, the stanchions, the load bearing member and the buoyant members, which engage the water to transfer the impact force to the water and arrest the motion of the vessel. The ballast member provides a force to restore the barrier to an upright position when the barrier rotates from vertical.

17 Claims, 44 Drawing Sheets

Related U.S. Application Data

(60) Provisional application No. 62/398,116, filed on Sep. 22, 2016.

(51) Int. Cl.
*E02B 3/20* (2006.01)
*E02B 15/08* (2006.01)

(56) References Cited

U.S. PATENT DOCUMENTS

| | | | |
|---|---|---|---|
| 6,681,709 | B1 | 1/2004 | Nixon et al. |
| 7,140,599 | B1 | 11/2006 | Spink |
| 8,622,650 | B2 | 1/2014 | Lifton |
| 8,928,480 | B2 | 1/2015 | Iffergan |
| 9,556,573 | B2 | 1/2017 | Betcher |
| 2004/0018060 | A1 | 1/2004 | Knezek et al. |
| 2005/0042033 | A1 | 2/2005 | Fong |
| 2009/0035068 | A1 | 2/2009 | Terai et al. |
| 2010/0178109 | A1 | 7/2010 | Wilson |
| 2013/0064605 | A1 | 3/2013 | Johnson |
| 2013/0129421 | A1 | 5/2013 | Belzile et al. |

MARINE BARRIER SYSTEMS

RELATED APPLICATIONS

This application is a continuation-in-part of U.S. patent application Ser. No. 15/712,220, which claims priority to U.S. Provisional Patent Application No. 62/398,116, filed Sep. 22, 2016, which is hereby incorporated by reference in its entirety.

TECHNICAL FIELD

The present subject matter relates to marine barriers. The present disclosure has particular applicability for barriers that are designed for open water (open ocean) or near-shore applications, and can be utilized in linear lengths or employed to protect single point moored systems.

BACKGROUND

Structures for use on both land and/or water as security barrier systems have been previously developed. Such structures generally intend to stop intruding objects, and range from thick, solid walls blocking the object's progress to secured areas for disabling the propelling mechanism of the object. These structures commonly exhibit noticeable shortcomings. First, these structures are often cumbersome and time-consuming to install and erect as and where desired. Second, they are difficult, or even impossible, to maintain and/or repair after they have sustained the impact of an intruding object. Third, they are often not adaptable to different needs and conditions.

Systems and technologies exist that can be used as marine barriers; for example, the United States Navy's well-known Port Security Barrier ("PSB"), the Dunlop Boat Barrier System, the WhisperWave® system, the Cochrane floating boat barrier, etc. The Dunlop Boat Barrier System consists of an inflated cylinder of a rubber coated textile eight (8) feet in diameter. This system is reportedly prone to leaking and cracking, resulting in reduced capability. The PSB is a net capture barrier designed to engage and stop an intruding vessel, consisting of a single net supported by a metallic framework, held above the water by pontoons. Its effectiveness is dependent upon successful engagement with the attacking vessel and sufficient water space to run out. The WhisperWave® barrier is a line of demarcation ("LOD") type system that consists of floating plastic modules. A single net is mounted on the modules to capture boats. The Cochrane floating boat barrier consists of multiple spherical floating buoys which are mechanically coupled together to allow rotation. Metallic spikes are mounted on the modulus to catch oncoming craft.

These legacy systems typically are designed to stop a vessel upon impact and/or are employed in near-water (or "near-shore") applications around ports and harbors. To the best of the Applicant's knowledge, only the PSB system has been deployed in an open water environment. It was installed at the Al Basrah Offshore Oil Terminal in Iraq; however, it was removed within a year, allegedly due to failed components due to the environmental loading.

There exists a need for a marine barrier that can survive the high-energy open ocean environment and vessel impacts, be able to "right itself" if it is rotated over 90 degrees, can be outfitted with an oil containment or subsurface net, and is economical to deploy in long lengths. There also exists a need for a near-shore marine barrier that can withstand vessel impacts, be able to "right itself" if it is rotated over 90 degrees, and is economical to deploy in long lengths.

SUMMARY OF THE DISCLOSURE

The present disclosure provides a marine security barrier system that addresses the aforementioned needs. The disclosed system furthers the state of the art of existing marine barrier technologies by being inherently stable up to at least 135 degree rotation from vertical, allowing the system to remain upright not only during impact events, but also in large wave events. The disclosed barrier can be outfitted in several basic configurations: (1) with two capture nets above the water surface for redundancy and weight distribution; (2) with a single net above the water surface; or (3) with a single net that extends above and below the water surface. The disclosed net attachment schemes allow the net(s) to deform and engage an impacting vessel. The net deformation and subsequent distribution of impact forces to the net attachment points allow the impacting energy to be transmitted along the structure's length. For nets that extend into the water, the netting can be used as an anti-swimmer defense as well as to keep floating debris out of the protected area. Finally, by employing modular stanchions to support the barrier's structure, various commercially available netting can be supported both above and below the water surface. This allows each system to be tailored to specific sites and/or requirements; e.g., heaver nets can be suspended with additional stanchions.

The disclosed barriers are inherently different than existing barriers for the following reasons, and are described in more detail herein below. The disclosed barrier systems can be equipped with one or two commercial off the shelf capture nets, either metallic or polymer. The system will "right itself" if it is rotated over 90 degrees from vertical due to ballast members below the water surface, utilizes stanchions for support above and below the waterline, in certain embodiments employs two nets for redundancy and even weight distribution, allows for a net to be placed through the water surface, and can be equipped with an oil containment or underwater net system, if needed.

Embodiments include a marine barrier comprising two substantially parallel elongate buoyant members spaced apart from each other, and an elongate net support member spaced from the buoyant members, disposed between the two buoyant members and above the buoyant members when the buoyant members are floating in a body of water. A plurality of substantially rigid first stanchions extend between the two buoyant members to maintain the spacing between the buoyant members, and a plurality of substantially rigid second stanchions each extend between one of the buoyant members and the net support member to maintain the spacing between the buoyant members and the net support member. An impact net is attached to the net support member and a first one of the buoyant members, or to the net support member and the plurality of first stanchions, such that when the buoyant members are floating in the body of water and a moving vessel impacts the impact net, the impact net deflects to transfer a force of the impact to one or more of the net support member, the first stanchions, the second stanchions, and the buoyant members, and the buoyant members in turn engage the water to transfer the force of the impact to the water and arrest the motion of the vessel.

Embodiments further include a marine barrier further comprising a second impact net attached to the net support member and a second one of the buoyant members. When the buoyant members are floating in the body of water, and the moving vessel impacts the first impact net, the first impact net deflects to transfer a force of the impact to the second impact net and to one or more of the net support member and the buoyant members, which in turn engage the water to transfer the force of the impact to the water and arrest the motion of the vessel.

Embodiments also include a marine barrier further comprising an elongate lower ballast member disposed between the two buoyant members and below the buoyant members when the buoyant members are floating in the body of water. The ballast member has ballast with sufficient weight to provide a restoring force to restore the barrier to an upright position when the buoyant members are floating in the body of water and the barrier rotates up to 135 degrees from vertical.

Embodiments also include a marine barrier comprising two substantially parallel elongate buoyant members spaced apart from each other, an elongate upper net support member spaced from the buoyant members, disposed between the two buoyant members and above the buoyant members when the buoyant members are floating in a body of water, and an elongate lower net support member spaced from the buoyant members, disposed between the buoyant members and below the buoyant members when the buoyant members are floating in the body of water. A plurality of substantially rigid first stanchions extend between the two buoyant members to maintain the spacing between the buoyant members. A plurality of substantially rigid second stanchions, each extending between one of the buoyant members and the upper net support member to maintain the spacing between the buoyant members and the upper net support member. A plurality of substantially rigid third stanchions, each extending between one of the buoyant members and the lower net support member to maintain the spacing between the buoyant members and the lower net support member. An impact net is attached to the upper net support member and the lower net support member, such that when the buoyant members are floating in the body of water and a moving vessel impacts the impact net, the impact net deflects to transfer a force of the impact to one or more of the net support members, the first stanchions, the second stanchions, the third stanchions, and the buoyant members, and the buoyant members in turn engage the water to transfer the force of the impact to the water and arrest the motion of the vessel.

Embodiments further include a marine barrier wherein the lower net support member has ballast with sufficient weight to provide a restoring force to restore the barrier to an upright position when the buoyant members are floating in the body of water and the barrier rotates up to 135 degrees from vertical.

In certain embodiments, the barrier is attachable to a second barrier substantially identical to the barrier by flexibly attaching a first end of the barrier to a corresponding first end of the second barrier. The barrier comprises a single elastic hinge joint and a hinge adapter at a barrier first end, the hinge adapter rigidly attachable to the net support member and the buoyant members, and also attachable to the elastic hinge joint. The elastic hinge joint is further attachable to the corresponding hinge adapter of the second barrier.

Embodiments further include a marine barrier comprising two substantially parallel elongate buoyant members spaced apart from each other; an elongate net support member spaced from the buoyant members, disposed between the two buoyant members and above the buoyant members when the buoyant members are floating in a body of water; and a single elongate main load bearing member spaced from the buoyant members and disposed between the buoyant members. A plurality of substantially rigid first stanchions each extend between one of the two buoyant members and the main load bearing member to maintain the spacing between the buoyant members and the main load bearing member. A plurality of substantially rigid second stanchions each extend between one of the buoyant members and the net support member to maintain the spacing between the buoyant members and the net support member. An impact net is attached to the net support member and the main load bearing member, such that when the buoyant members are floating in the body of water and a moving vessel impacts the impact net, the impact net deflects to transfer a force of the impact to the net support member, the main load bearing member, the first stanchions, the second stanchions, and the buoyant members, and the buoyant members in turn engage the water to transfer the force of the impact to the water and arrest the motion of the vessel. One of the plurality of first stanchions extending between a first one of the buoyant members and the main load bearing member, another one of the first stanchions extending between a second one of the buoyant members and the main load bearing member, one of the plurality of second stanchions extending between the first one of the buoyant members and the net support member, and another one of the plurality of second stanchions extending between a second one of the buoyant members and the net support member are attached to each other to form a first truss. The first truss has fittings joining adjacent stanchions of the first truss to each other, and is configured to connect the first and second buoyant members, the main load bearing member, and the net support member.

Embodiments include the use of modular stanchions that allow increased/decreased structural support depending upon the local environmental forcing or site specific requirements.

Embodiments include the use of commercial off the shelf capture nets to absorb the impact energy from a vessel. These nets can be metallic ring nets, such as rockfall netting, or polymer nets.

Embodiments include the ability to add modular mooring points and/or supporting lines for station-keeping and use around a single point moored vessel, that tie into commercially available flanged connections.

Embodiments include the ability to suspend one or two nets above and/or below the water surface as a single unit or separate above and below water nets.

Embodiments include the ability to integrate an oil containment system into the structure to allow it to be used to contain spills of chemicals, oils, etc. on or near the water surface.

Objects and advantages of embodiments of the disclosed subject matter will become apparent from the following description when considered in conjunction with the accompanying drawings. Additionally, the different configurations discussed in the sections below may be performed in a different order or simultaneously with each other.

BRIEF DESCRIPTION OF THE DRAWINGS

Embodiments will hereinafter be described in detail below with reference to the accompanying drawings, which illustrate the present disclosure and, together with the description, further serve to explain the principles of the present disclosure and to enable a person skilled in the relevant art(s) to make and use the disclosed barriers. The accompanying drawings have not necessarily been drawn to scale. Where applicable, some features may not be illustrated to assist in the description of underlying features.

DETAILED DESCRIPTION

Figure 1A:
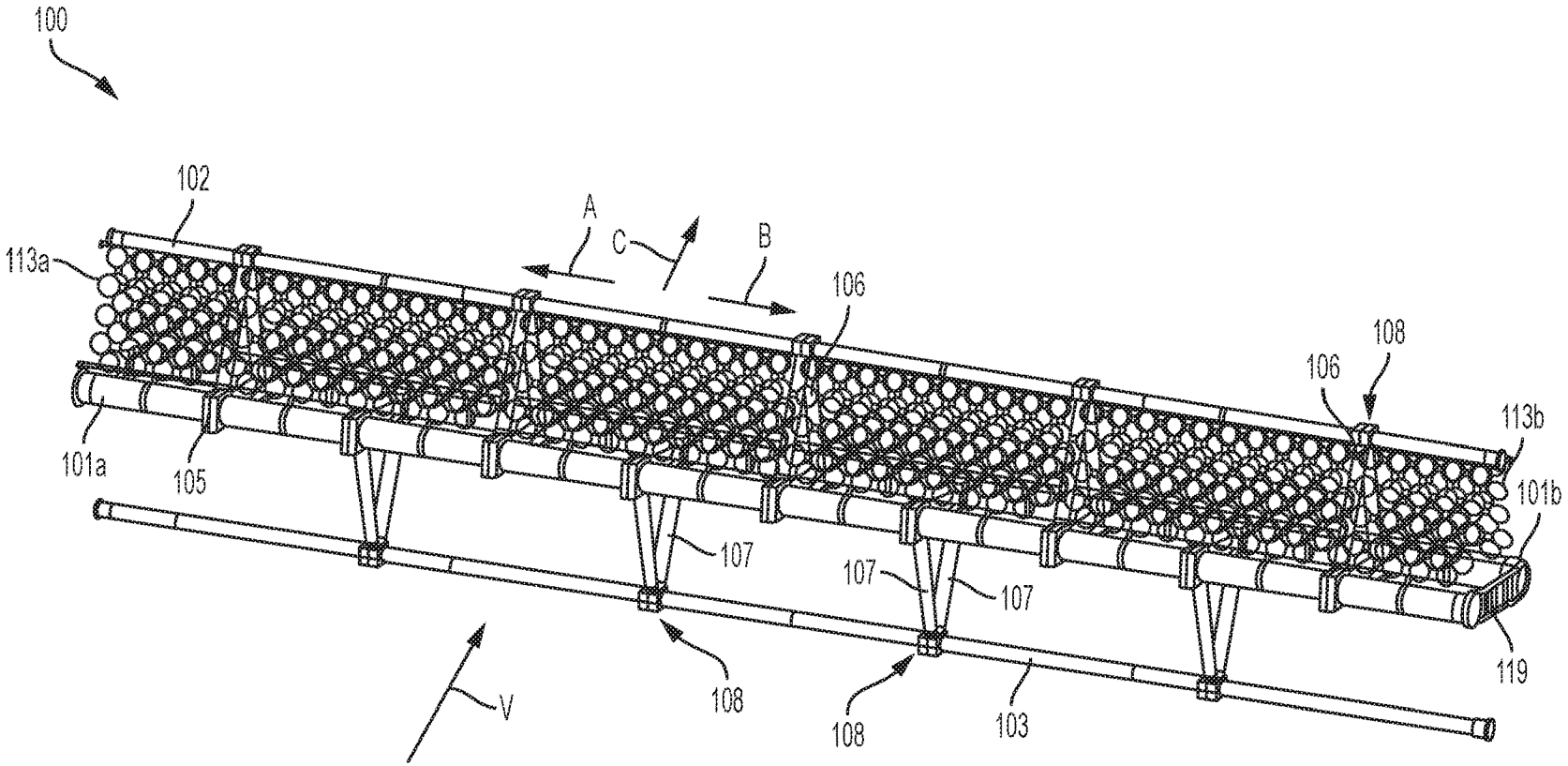
FIG. 1*a* is a perspective view of a marine barrier according to an embodiment of the disclosure.

It should be understood that the principles described herein are not limited in application to the details of construction or the arrangement of components set forth in the following description or illustrated in the following drawings. The principles can be embodied in other embodiments and can be practiced or carried out in various ways. Also, it is to be understood that the phraseology and terminology used herein is for the purpose of description and should not be regarded as limiting.

The embodiments described herein are referred in the specification as "one embodiment," "an embodiment," "an example embodiment," etc. These references indicate that the embodiment(s) described can include a particular feature, structure, or characteristic, but every embodiment does not necessarily include every described feature, structure, or characteristic. Further, when a particular feature, structure, or characteristic is described in connection with an embodiment, it is understood that it is within the knowledge of one skilled in the art to affect such feature, structure, or characteristic in connection with other embodiments whether or not explicitly described.

Embodiments of the disclosure will now be described in detail with reference to FIGS. 1*a*-11, which illustrate marine barriers made primarily of HDPE pipe and commercial off the shelf impact netting that can be used in open water conditions to protect various assets.

FIGS. 1*a*, 2*a-b*, 3*a-c*, and 4 illustrate a marine barrier 100 according to one embodiment of the disclosure. The terms "barrier" and "barrier unit" are used interchangeably throughout this disclosure. As explained in detail herein below, two or more barrier units can be joined end-to-end to form a "barrier system." Barrier 100 comprises two substantially parallel elongate buoyant members 101*a* and 101*b*, such as foam-filled high-density polyethylene (HDPE) flotation pipes, spaced apart from each other. An elongate net support member 102 is spaced from the buoyant members 101*a*, 101*b*, disposed between the two buoyant members 101*a*, 101*b* and above the buoyant members 101*a*, 101*b* when the buoyant members are floating in a body of water W. In certain embodiments, the net support member 102 is an HDPE pipe co-extruded to increase visibility (e.g., in alternating red and white colors). An elongate lower ballast member 103 filled with ballast 104 (also shown in FIG. 11) is spaced from the two buoyant members 101*a*, 101*b*, and disposed between the buoyant members 101*a*, 101*b* and below the buoyant members 101*a*, 101*b* when the buoyant members are floating in the body of water W. In some embodiments, the lower ballast member 103 is the same type HDPE pipe as the net support member 102, either the same colors or standard black.

A plurality of substantially rigid first stanchions 105 extend between the two buoyant members 101*a*, 101*b* to maintain the spacing between the buoyant members. A plurality of substantially rigid second stanchions 106 extend between one of the buoyant members 101*a*, 101*b* and the net support member 102 to maintain the spacing between the buoyant members 101*a*, 101*b* and the net support member 102. A plurality of substantially rigid third stanchions 107 extend between one of the buoyant members 101*a*, 101*b* and the lower ballast member 103 to maintain the spacing between the buoyant members 101*a*, 101*b* and the lower ballast member 103.

Figure 6A:
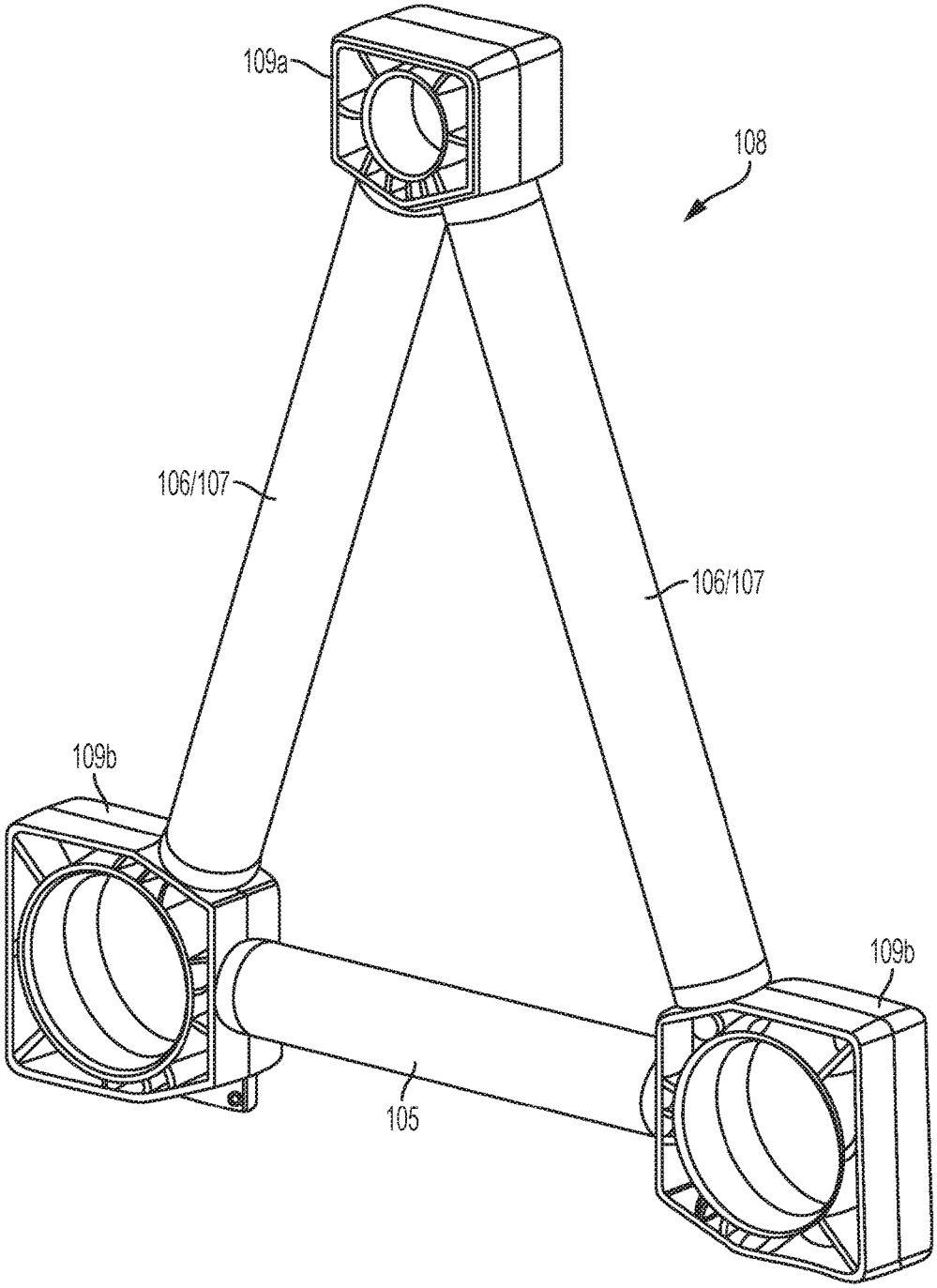
FIGS. 6*a-c* illustrate stanchions usable with the disclosed barriers.

In certain embodiments, the first, second, and third stanchions 105, 106, 107 comprise molded HDPE parts and HDPE pipe that are joined together to form a truss 108 (see FIG. 6*a*). Molded HDPE joints 109*a*, 109*b* are fused to foam-filled or hollow HDPE pipes 105, 106, 107 forming a modular truss 108 including one of the plurality of first stanchions 105 and two of the plurality of second stanchions 106 (or two of the plurality of third stanchions 107). The joints 109*a-b* are custom molded parts, and the stanchions 105, 106, 107 connecting the molded fittings 109*a* and 109*b* are standard HDPE pipes. In some embodiments, such as shown in FIG. 1*a*, the same truss 108 is used to support the net support member 102 and the lower ballast member 103.

Figure 6B:
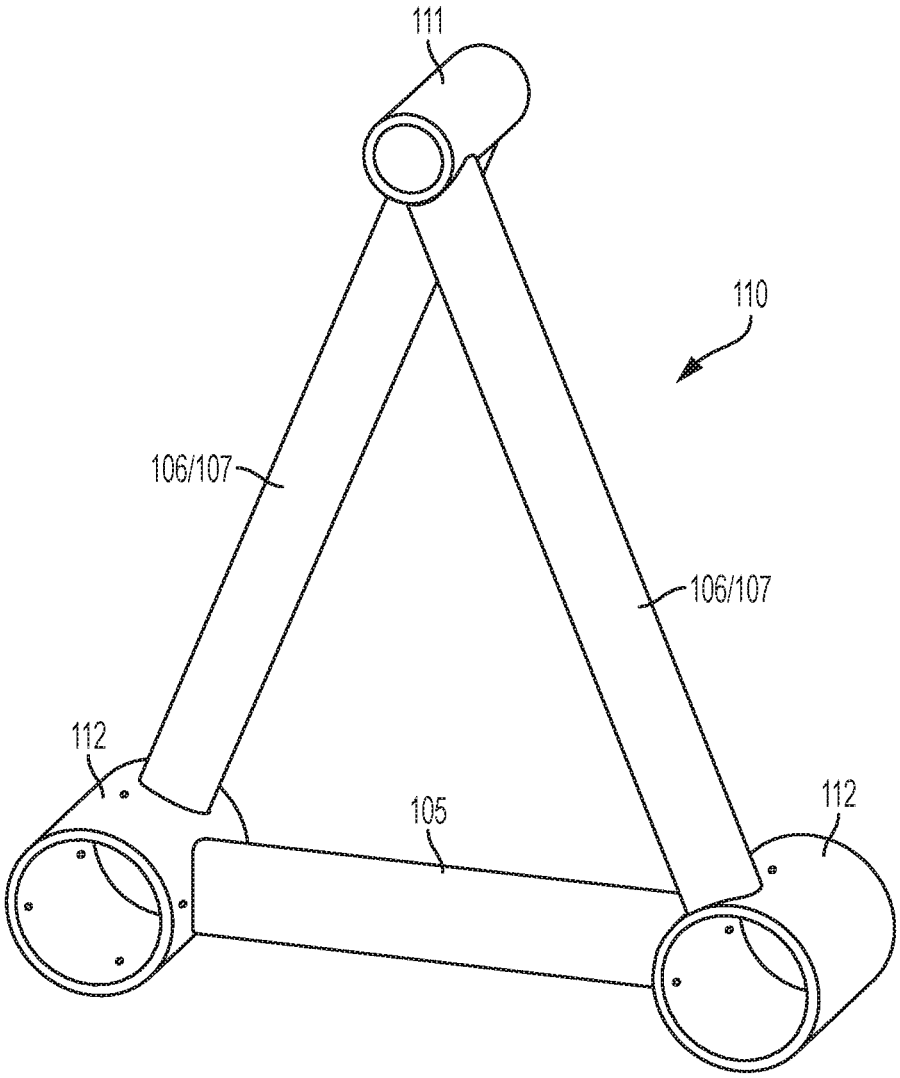

In other embodiments shown in FIG. 6*b*, all parts of a truss 110 comprise standard HDPE pipe sections fused together, including the first, second, and third stanchions 105, 106, 107, and support pipes 111, 112. There are no custom molded parts. The horizontal pipes of the barrier (net support member 102, buoyant members 101*a*, 101*b*, lower ballast member 103) slide through the upper support pipe 111 and main support pipes of the truss 112, respectively, since these are of a larger diameter. The truss 110 is then pinned or welded in place.

Referring again to FIG. 1*a*, a first impact net 113*a* is attached to the net support member 102 and a first one of the buoyant members 101*a*, and a second impact net 113*b* is attached to the net support member 102 and a second one of the buoyant members 101*b*. The nets 113*a*, 113*b* can be polymer netting fabricated or sown from a fiber such as Dyneema®, or metallic netting; e.g., conventional rockfall netting such as the MAC.RO. Systems HEA Panel available from Maccaferri Inc. of Williamsport, Md., USA. In certain embodiments, the metallic net is made from stainless steel rings designed to absorb up to 1500 kJ of energy during plastic deformation. In other embodiments, the metallic net comprises metal rope.

Figure 5A:
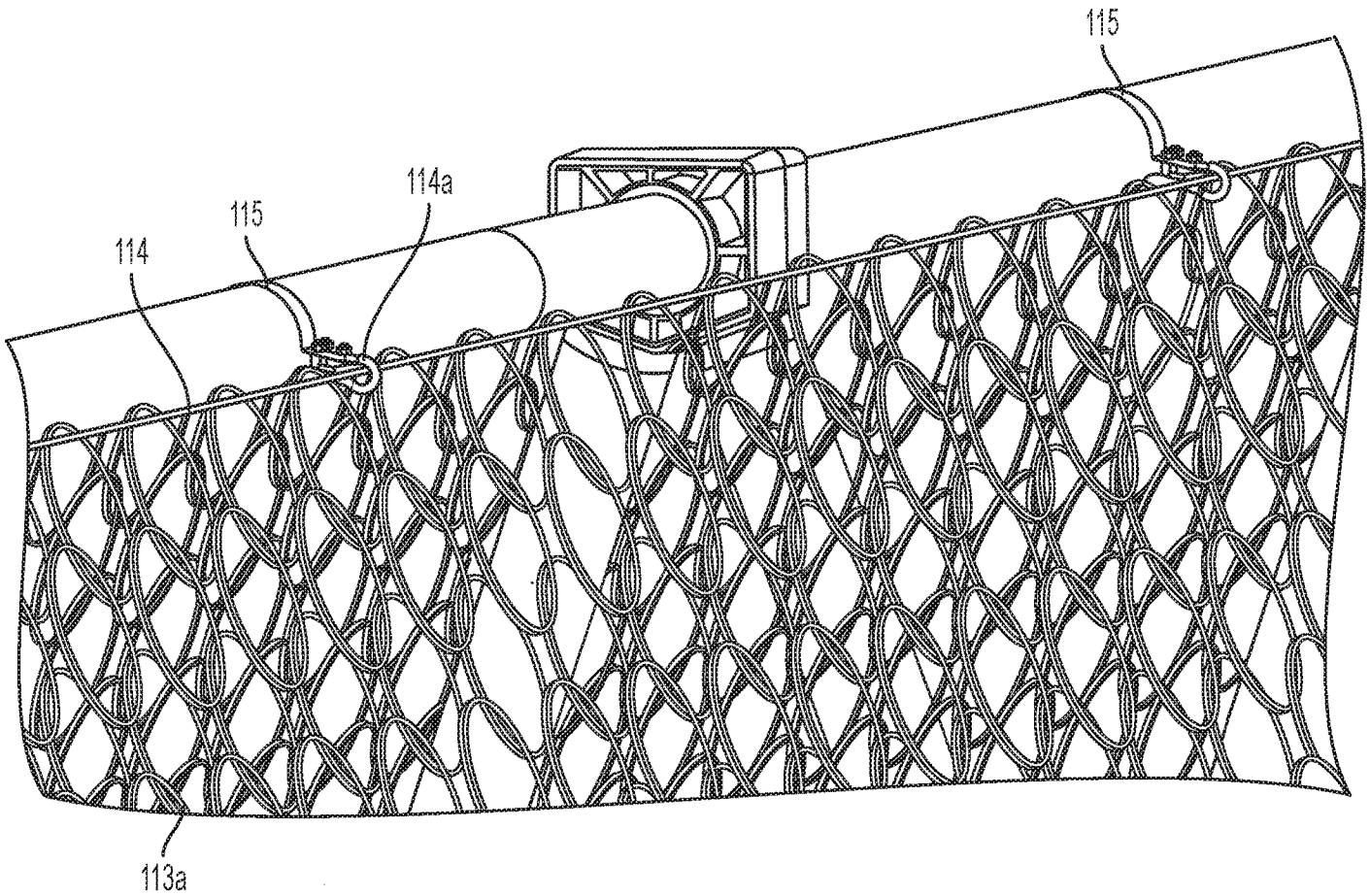
FIG. 5*a* is a partial perspective view of the barrier of FIG. 1*a*, showing a net attachment technique.
Figure 5C:
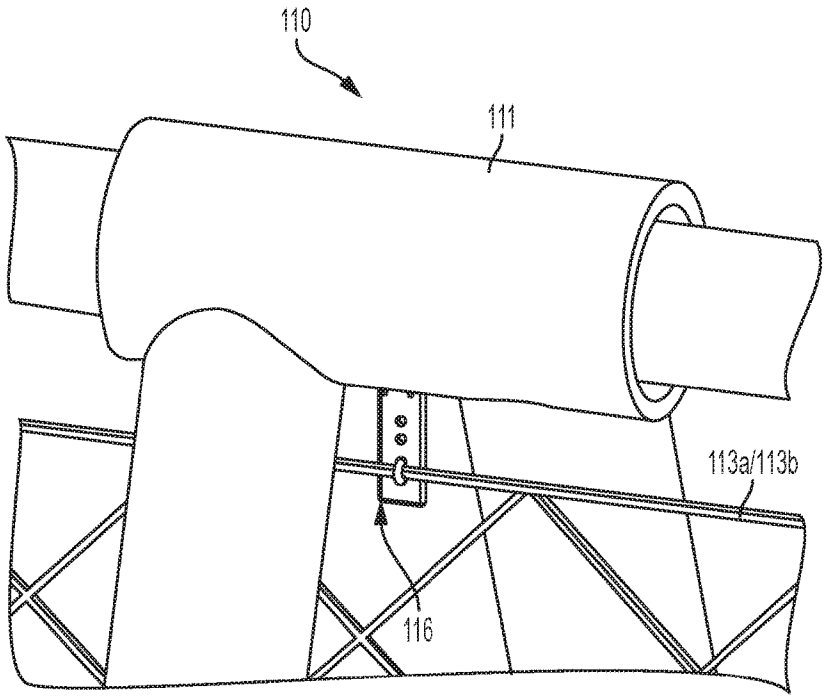
FIGS. 5*b* and 5*c* illustrate a net attachment bracket according to an embodiment of the present disclosure.
Figure 5B:
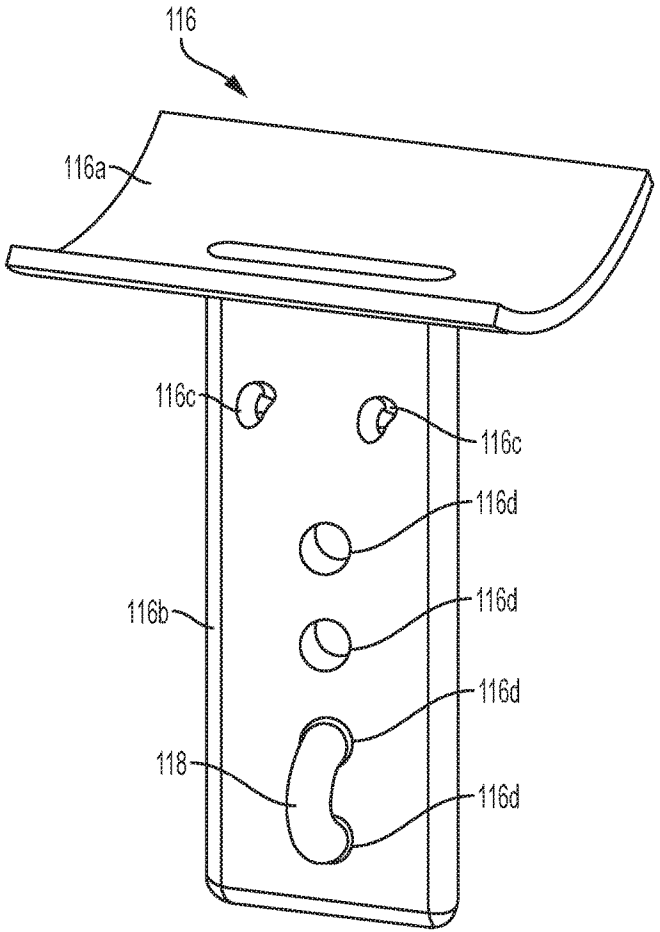
Figure 12:
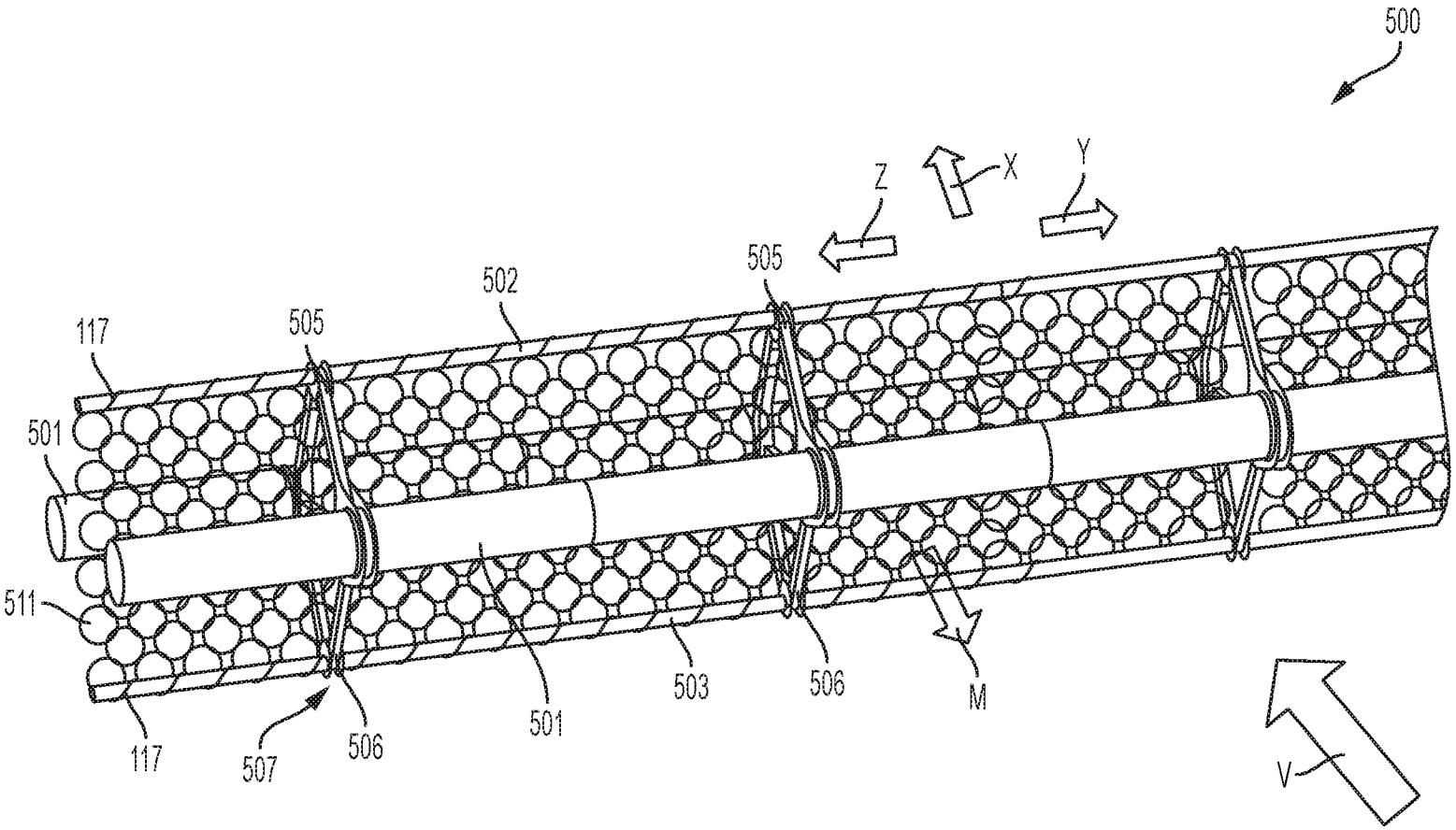
FIG. 12 is a partial perspective view of a marine barrier according to a further embodiment of the present disclosure.

The nets 113*a*, 113*b* are attached to the net support member 102 and the buoyant members 101*a*, 101*b* in certain embodiments via wire or polymer rope 114 and pipe bands 115, as shown in FIG. 5*a*, or by brackets 116 as shown in FIGS. 5*b-c*, or by looped wire 117, as shown in FIG. 12 (i.e., a stainless steel wire looped around the net support member engages an outer portion of the net). The pipe band technique is commonly used to hold components around pipe. The disclosed attachment scheme of FIG. 5*a* is similar, except the pipe band 115 holds a wire or polymer rope 114, which is either run through the netting 113*a* or above the netting 113*a*. If the rope 114 is run above the netting 113*a*, then shackles 114*a* are used to connect the rope 114 to the netting 113*a*.

In certain embodiments shown in FIGS. 5*b-c*, brackets 116 are provided for attaching an impact net to the net support member 102; for example, when a truss 110 as shown in FIG. 6*b* is used. The brackets 116 each have a first portion 116*a* for insertion between the net support member 102 and the upper support pipe 111 of one of the second stanchions 106 of a truss 110, and a second portion 116*b* extending through the upper support pipe 111 for attaching to an impact net 113*a*/113*b*. The bracket 116 is made of stainless steel. The first portion 116*a* of the bracket is curved to fit within the upper support pipe 111 of a truss 110 such as shown in FIG. 6*b*. The support pipe 111 has a slot cut out of it (not shown) that allows the bracket 116 to be inserted and dropped into the slot. The HDPE net support pipe 102 is then set on top of the bracket's first portion 116*a* when it is assembled to the truss 110. Once the bracket 116 is in place, cotter pins (or equivalent) are inserted into the upper holes 116*c* to retain it. The net is attached to the second portion 116*b* of the bracket using a standard wire rope clip 118 to adjacent ones of holes 116*d*, holding the net 113*a*/113*b*.

Figure 11:
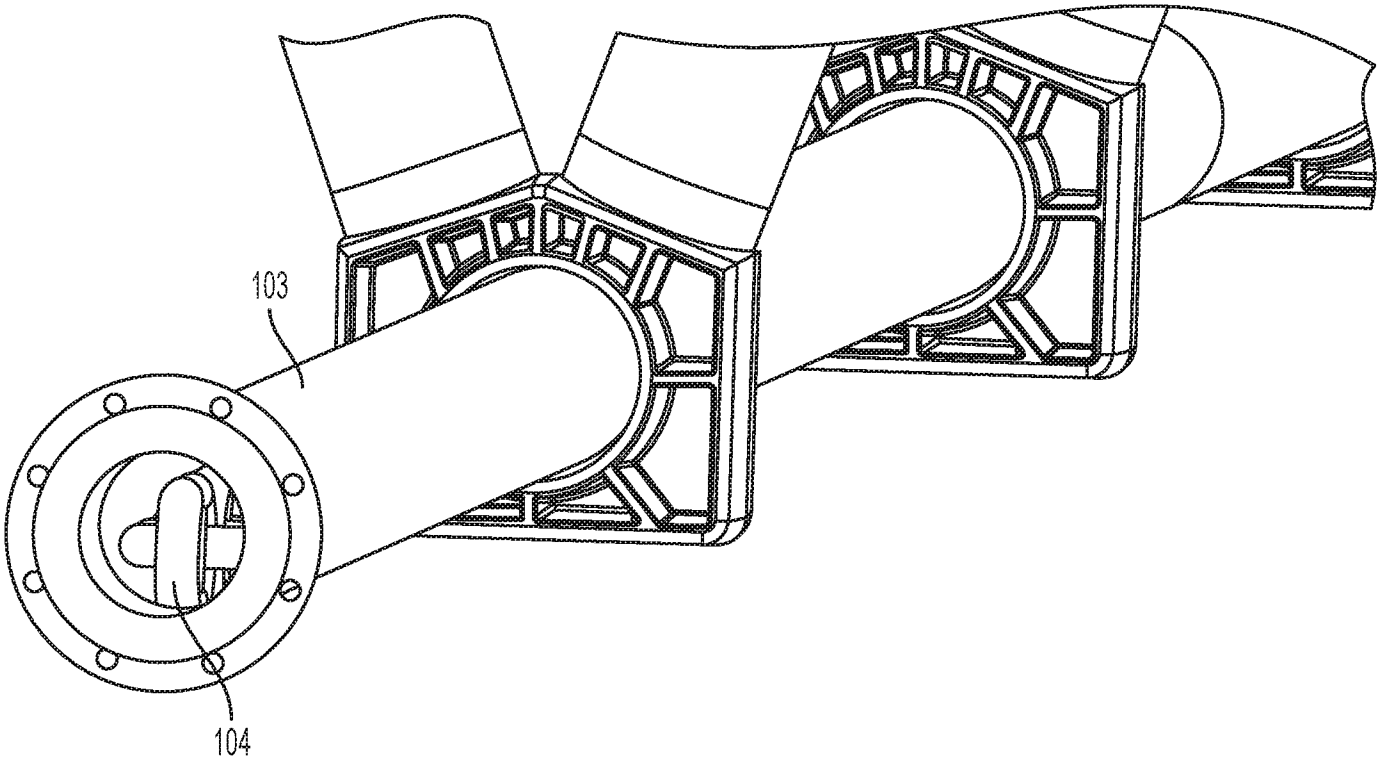
FIG. 11 is a partial perspective view showing ballast in the lower pipe of the disclosed barriers.

The lower ballast member 103 is filled with ballast 104 having sufficient weight to provide a restoring force to restore the barrier 100 to an upright position when the buoyant members 101*a*, 101*b* are floating in the body of water W and the barrier 100 rotates from the upright position. As shown in FIG. 11, the ballast 104 can be a chain inside the lower ballast member 103. The ballast 104 allows the system to withstand knock-over or high rotation events, up to 135 degrees rotation from vertical, and return to an upright position. Thus, the barrier 100 is very stable in the marine environment; for example, when it encounters large waves, etc.

Figure 3C:
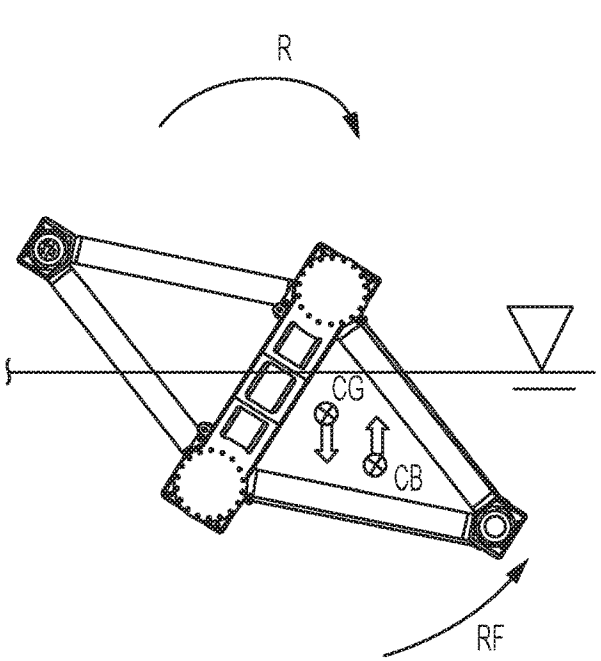
FIGS. 3*a-c* show the barrier of FIG. 1*a* at several rotational positions.
Figure 3B:
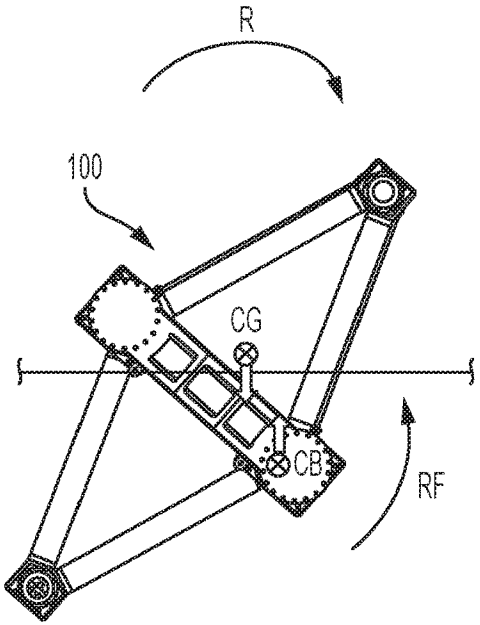
Figure 3A:
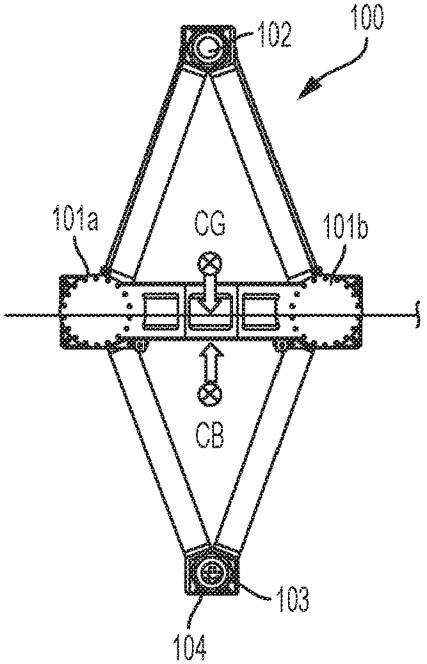

Referring now to FIGS. 3*a-c*, the disclosed barrier 100 remains stable by distributing the weight and buoyancy of the barrier 100 to insure that the barrier's buoyancy (which acts at its center of buoyancy CB) counters its weight (acting at the center of gravity CG) up to a rotation of 135 degrees from vertical. Since the center of gravity CG remains static, and the center of buoyancy CB adjusts based on the subjected volume, the barrier wants to sit upright as it is forced over in a direction R (as shown in FIGS. 3*b* and 3*c*), because its buoyancy provides a restoring force RF to push the system back upright. This force RF remains positive (i.e., acting towards putting the barrier upright) up to a 135 degree rotation.

Figure 4:
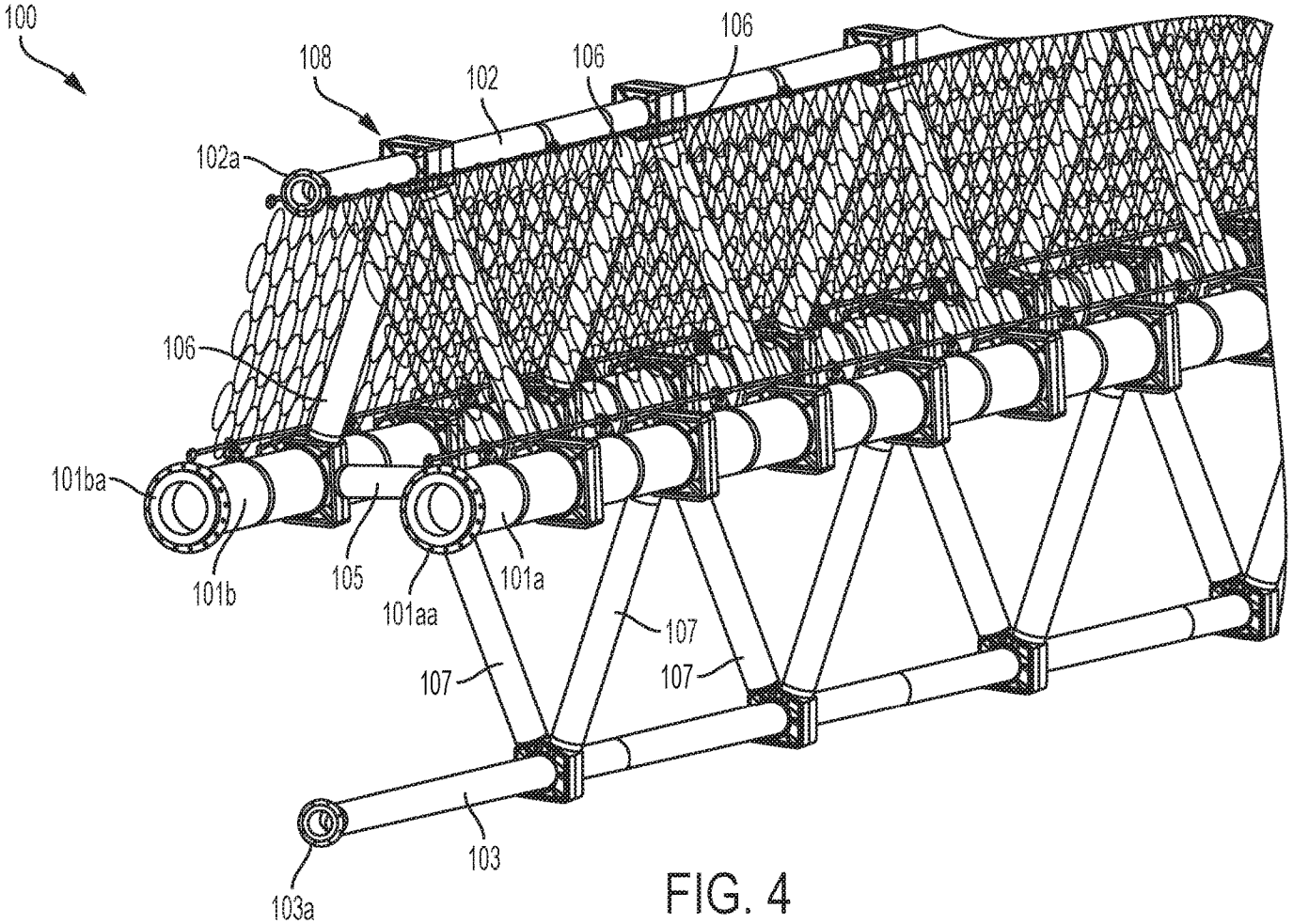
FIG. 4 is a partial perspective view of the barrier of FIG. 1*a*, showing flanged connections located at the end of each barrier section.

The ends of each barrier unit 100 have flanged connections 101*aa*, 101*ba*, 102*a*, 103*a*, as shown in FIG. 4, to attach to other lengths of barrier, or to end connections. Flanged ends such as 101*aa*, 101*ba*, 102*a*, 103*a* are common in the HDPE pipe industry, and are used to join HDPE pipe to steel pipe. Barrier units 100 can be joined to each other end-to-end to form a barrier system, as by bolting together using standard flange adapters.

Figure 7:
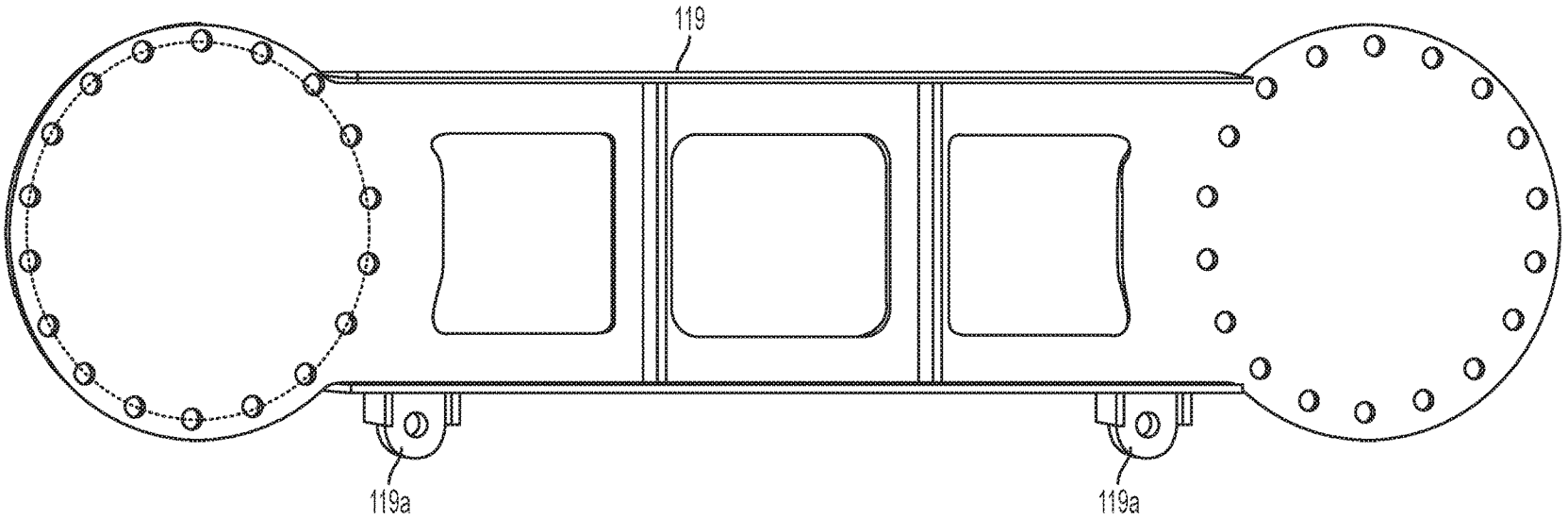
FIG. 7 is a perspective view of a mooring plate usable with the disclosed barriers.

In some embodiments, a mooring plate 119 as shown in FIG. 7 is attached to and extends between a first end of the first one of the buoyant members 101*a* and a corresponding first end of a second one of the buoyant members 101*a*. The mooring plate 119 has a pad-eye 119*a* for attaching a mooring line. Mooring plates 119 can be added between barrier units 100 to secure the barrier system to the seafloor or for towing purposes. These plates 119 have a similar bolt pattern to the flanges 101*aa*, 101*ba*, such that the bolts used to connect barrier units can also be used to fasten the mooring plates 119.

Barrier unit 100 has a length L of about 40 feet or more in some embodiments, for shipping purposes. The length L is variable depending on mooring requirements, as the mooring padeyes 119*a* are located on mooring plates 119, where barrier units 100 are bolted together.

When the buoyant members 101*a*, 101*b* are floating in the body of water, and a moving vessel V impacts the first impact net 113*a* (see FIG. 2*b*), the first impact net 113*a* deflects to transfer a force of the impact to the second impact net 113*b* and to one or more of the net support member 102, the first stanchions 105, the second stanchions 106, and the buoyant members 101*a*, 101*b*, and the buoyant members in turn engage the water W to transfer the force of the impact to the water W and arrest the motion of the vessel V.

The net 113*a* will engage and deform around the bow of the vessel V prior to the vessel V coming in contact with the HDPE pipes 101*a*, 101*b*, 102. As detailed in FIG. 1*a*, the front net 113*a* undergoes plastic deformation at the local area of impact, elongating and thereby absorbing energy. After less than one meter of deformation, the rear impact net 113*b* engages, proving redundant support and energy absorption as the local impact area deforms. During the process, the nets transfer force to the net connection points to the net support member 102, the buoyant members 101*a*, 101*b*, and the stanchions 105, 106 (see arrows A, B, and C). These then drag through the water W, absorbing energy. Energy can be transferred down to the system's mooring, if impacted at a mooring location; however, the net(s) 113*a*, 113*b* are sized to absorb the full load of the vessel V.

Figure 2A:
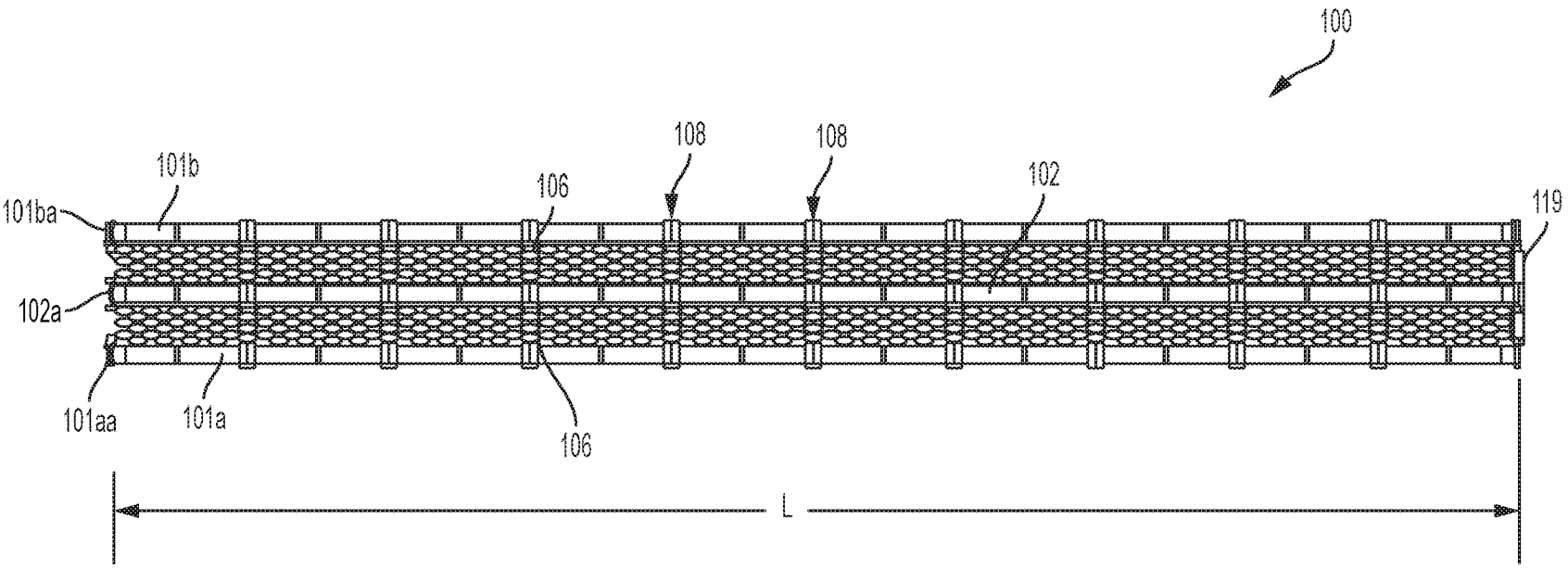
FIG. 2*a* is a top view of the barrier of FIG. 1*a*.
Figure 2B:
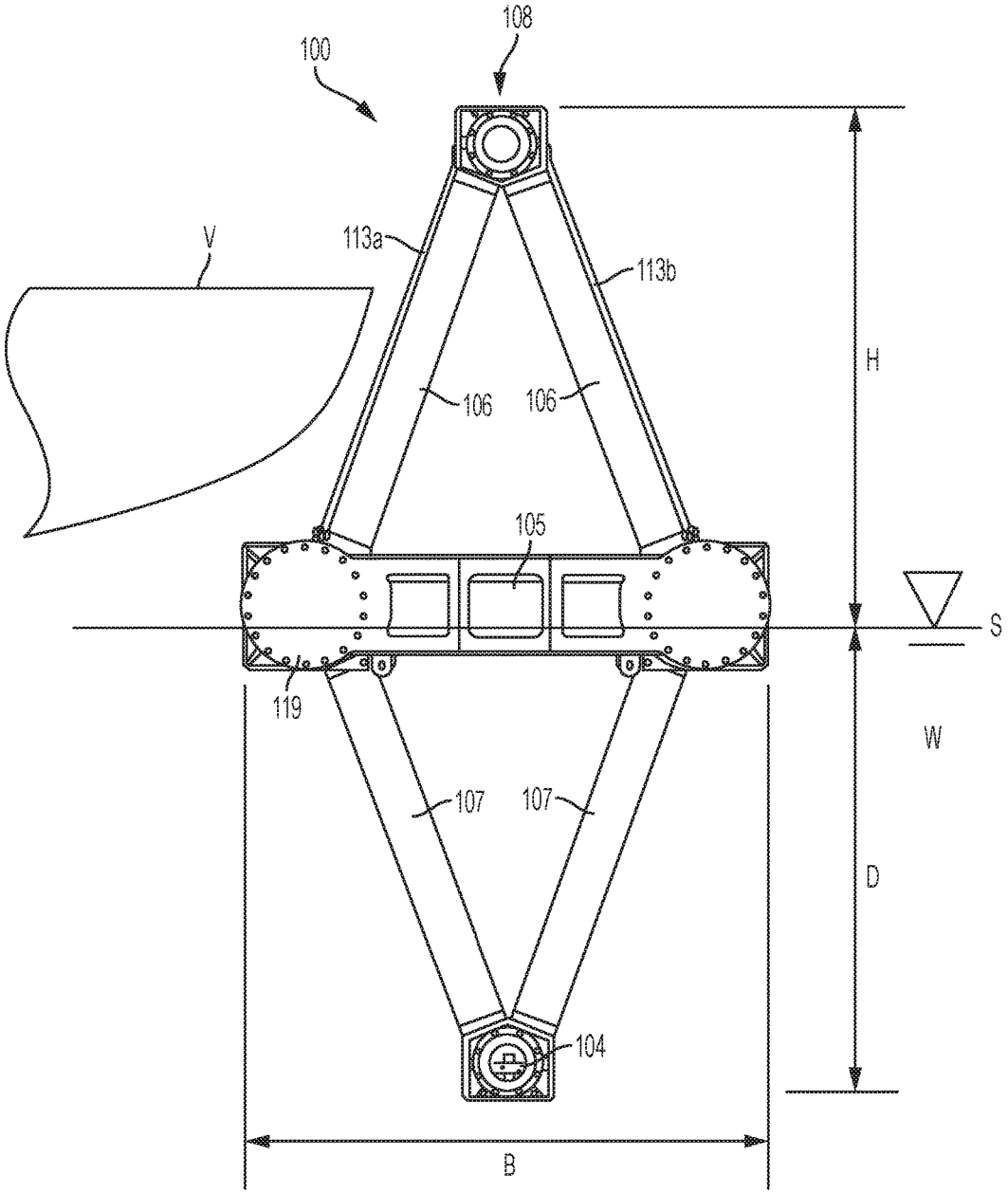
FIG. 2*b* is an end view of the barrier of FIG. 1*a*.

As shown in FIG. 2*b*, when a vessel impacts the barrier 100, the forces are transferred to the barrier 100 as the bow of the vessel V engages the front impact net 113*a*. In certain embodiments, the barrier height H above the surface S of the water W is such that it will engage the bow of vessels having up to the maximum kinetic energy associated with 99% of all small boats in the U.S., according to U.S. Navy requirements for boat barriers. This maximum kinetic energy is 520,000 lbs-ft. The *Standard Test Method for Boat Barriers*, Designation: F2766-11, ASTM International (June 2011) details vessels associated with different impact energies. Per the ASTM Method, the barriers of these embodiments are sized to capture a boat having a static freeboard of 4 ft or less, and a rake of 0-30 degrees. For example, in one embodiment the barrier 100 shown in FIG. 2*b* has a height H of 2.9 meters, a draft D of 2.9 meters, and a beam B of 2.4 meters. In another embodiment, the barrier 100 shown in FIG. 2*b* has a height H of 2.3 meters, a draft D of 2.3 meters, and a beam B of 1.9 meters. In yet another embodiment, the barrier 100 shown in FIG. 2*b* has a height H of 2 meters, a draft D of 2 meters, and a beam B of 1.65 meters. In the foregoing examples, the beam B is approximately 82% of the height H and draft D. This relationship provides good stability and a height above water that will engage vessels, without the beam being so large that it becomes cumbersome.

Figure 1B:
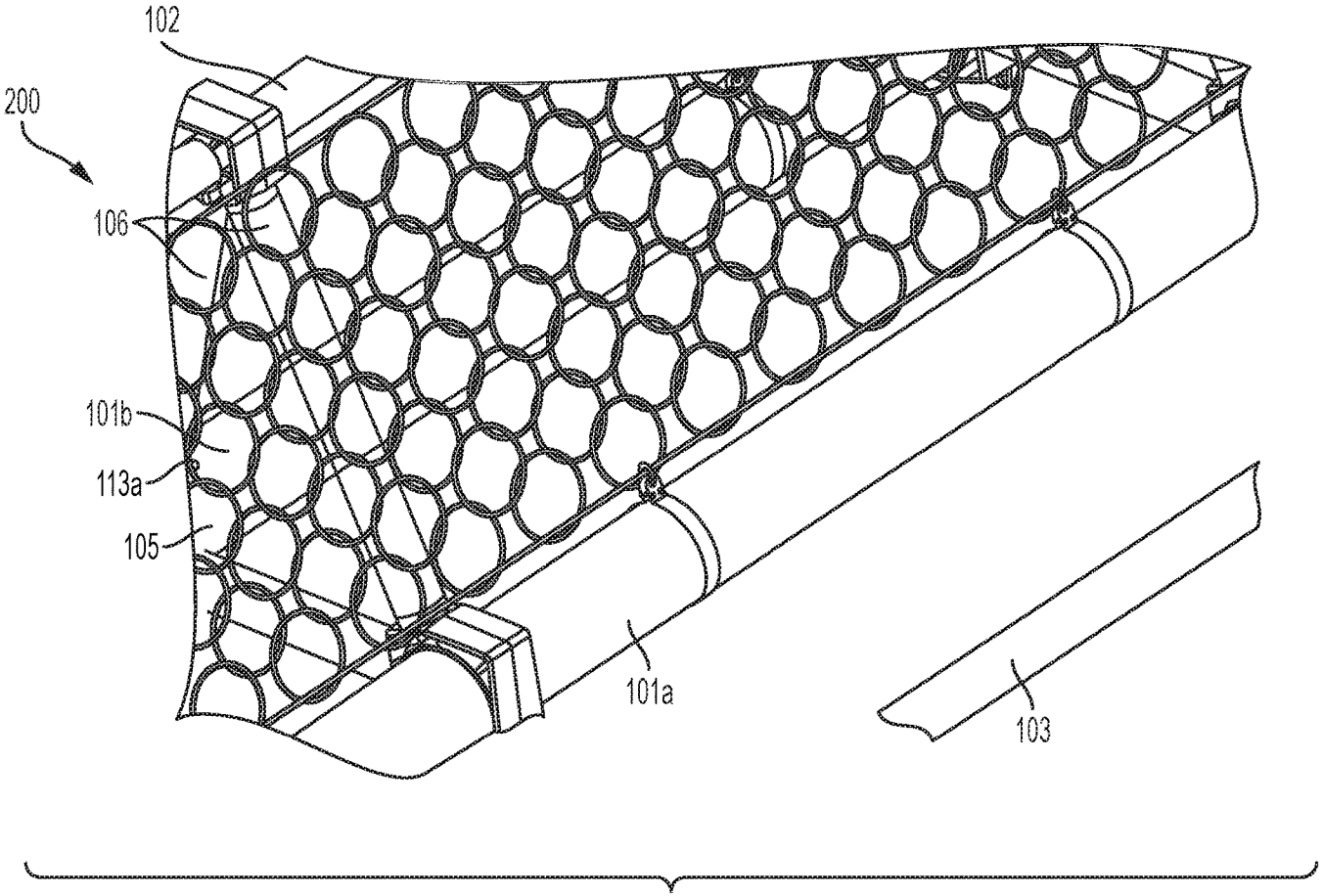
FIG. 1*b* is a perspective view of a marine barrier according to a further embodiment of the disclosure.

In an alternative embodiment shown in FIG. 1*b*, the disclosed barrier has a single net 113*a* attached between the net support member 102 and one of the buoyant members 101*a*, 101*b*, rather than two nets. It is otherwise structurally similar or identical to the embodiment of FIG. 1*a*. In this embodiment, when the buoyant members 101*a*, 101*b* are floating in the body of water, and a moving vessel impacts the single impact net 113*a*, the impact net deflects to transfer a force of the impact to one or more of the net support member 102, the first stanchions 105, the second stanchions 106, and the buoyant members 101*a*, 101*b*, and the buoyant members 101*a*, 101*b* in turn engage the water to transfer the force of the impact to the water and arrest the motion of the vessel.

Figure 8:
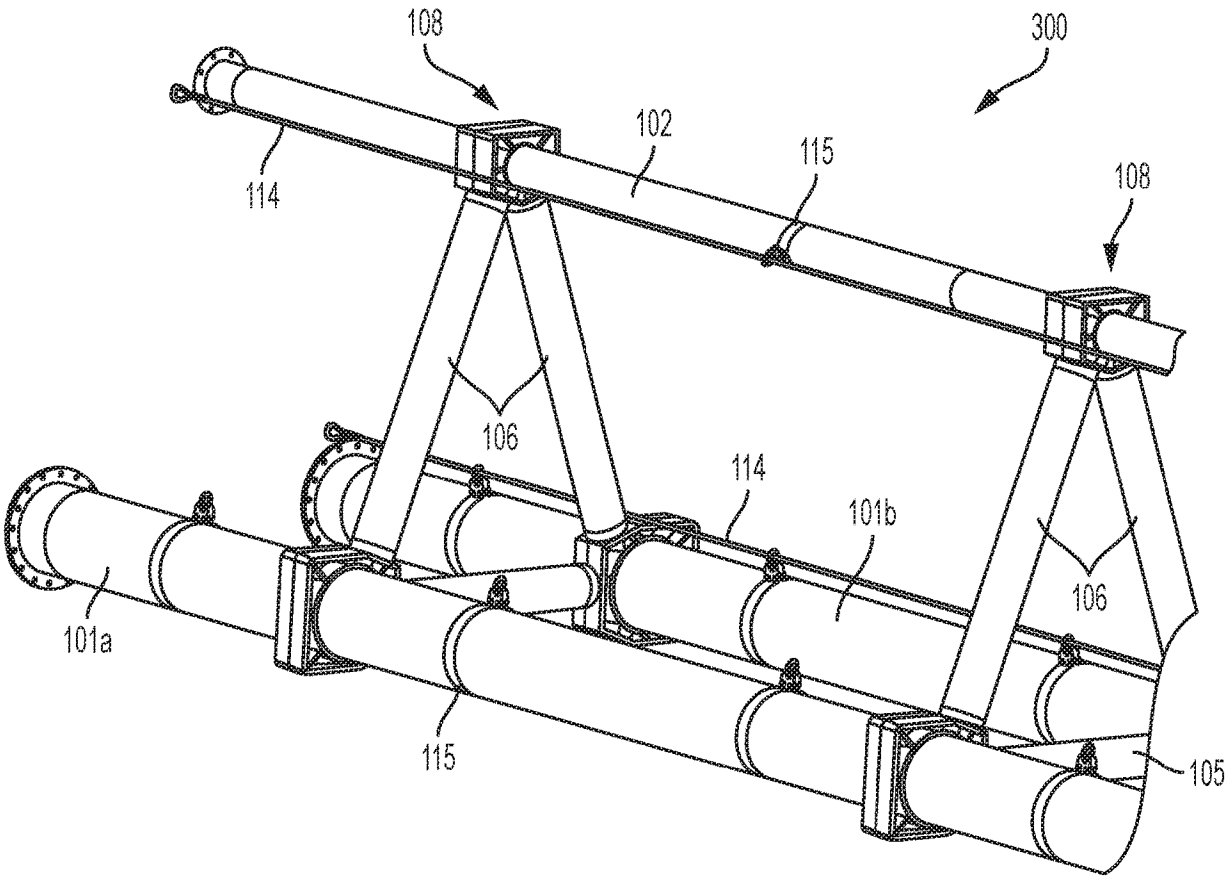
FIG. 8 is a partial perspective view of a marine barrier without a lower ballast pipe, according to a further embodiment of the present disclosure.

FIG. 8 illustrates an embodiment of a marine barrier 300 without a lower ballast pipe. It is otherwise structurally similar or identical to the embodiment of FIG. 1*a*. The nets are not shown, for clarity. This embodiment is usable where the environment does not require added ballast below the surface of the water.

Figure 9A:
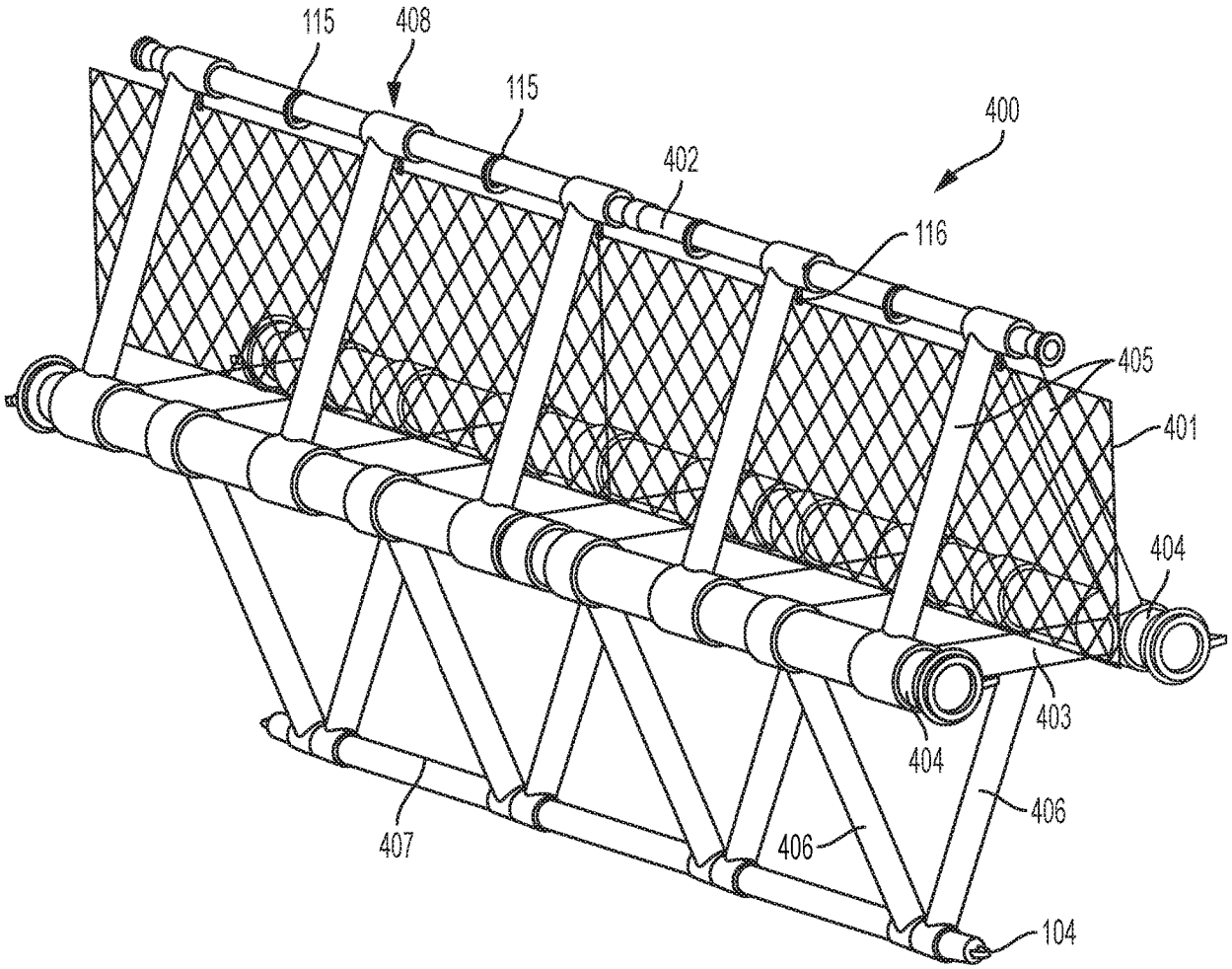
FIG. 9*a* is a perspective view of a marine barrier according to a further embodiment of the present disclosure.
Figure 9B:
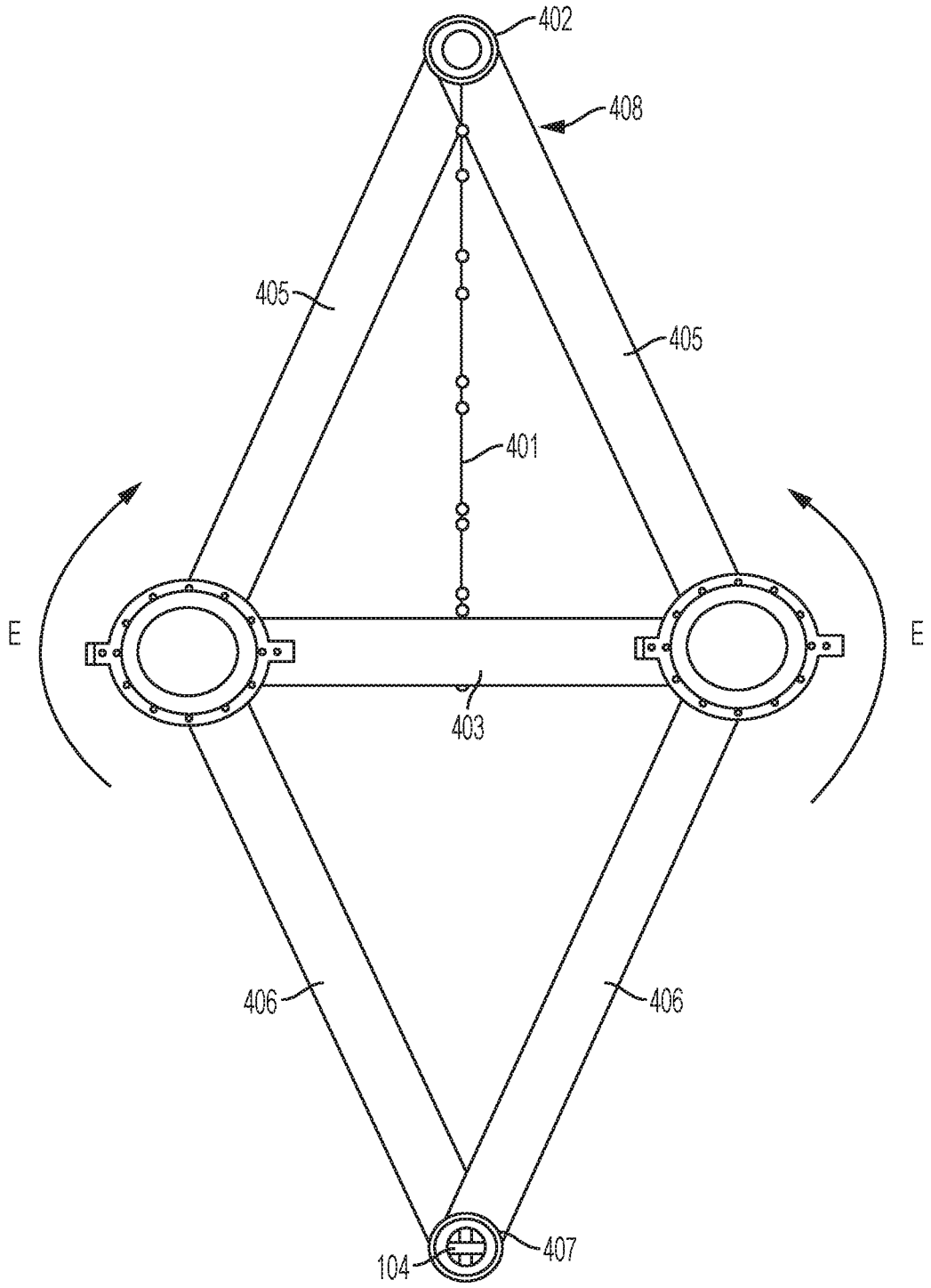
FIG. 9*b* is an end view of the barrier of FIG. 9*a*.

In a further alternative embodiment shown in FIGS. 9*a*-9*d*, in a barrier 400 a substantially vertical impact net 401 is attached between a net support member 402 and a plurality of first stanchions 403 extending between two elongate buoyant members 404. FIG. 9*b* shows an end view of the barrier 400, showing the single net 401 secured in the middle of the barrier 400. It is otherwise structurally similar to the embodiments of FIGS. 1*a* and 1*b*, and thus also has a plurality of substantially rigid second stanchions 405 extending between one of the buoyant members 404 and the net support member 402 to maintain the spacing between the buoyant members 404 and the net support member 402, and a plurality of substantially rigid third stanchions 406 extending between one of the buoyant members 404 and an elongate lower ballast member 407 to maintain the spacing between the buoyant members 404 and the lower ballast member 407.

In this embodiment, when the buoyant members 404 are floating in a body of water, and a moving vessel impacts the single impact net 401, the impact net 401 deflects to transfer a force of the impact to one or more of the net support member 402, the first stanchions 403, the second stanchions 405, and the buoyant members 404, and the buoyant members 404 in turn engage the water to transfer the force of the impact to the water and arrest the motion of the vessel. The impact net 401 comprises the metallic or polymer netting described herein above. Thus, when impacted, the barrier 400 of this embodiment will behave similarly to the barriers of the previously-described embodiments.

Figure 6C:
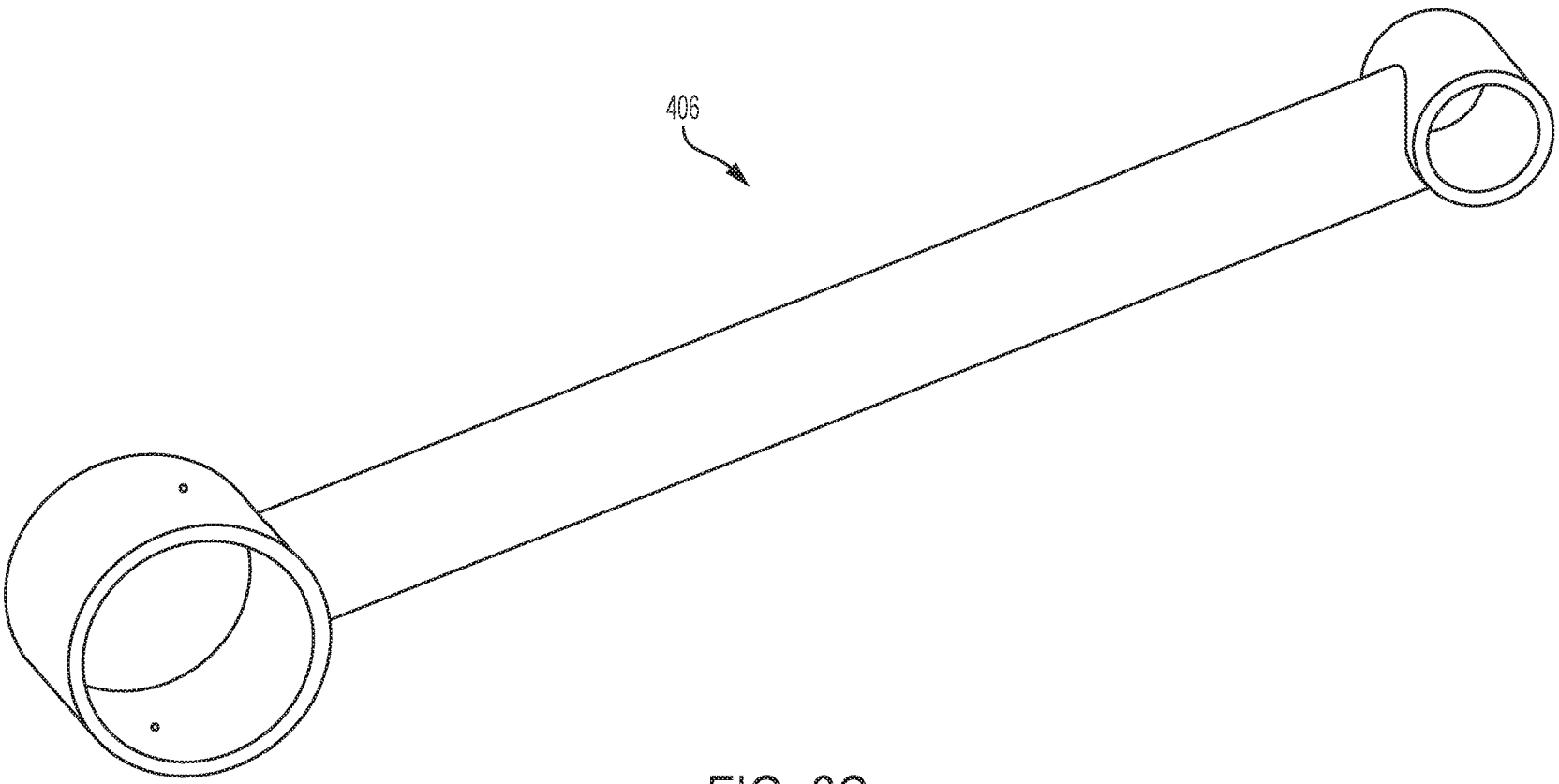

In certain embodiments best seen in FIGS. 9*a*-*b*, the first and second stanchions 403, 405 are joined together in a triangular truss 408 similar or identical to the triangular truss 110 of FIG. 6*b* (the truss 108 of FIG. 6*a* can also be used); however, the third stanchions 406 are separate units as shown in FIG. 6*c*, and two of these units 406 are used in unison to support a section of the ballast pipe 407. All materials, construction and securement are similar to the triangular truss 108 of FIG. 6*a*. The use of separate third stanchions 406 is advantageous in that, during assembly of the barrier 400, the third stanchions 406 are rotated up as indicated by arrows E in FIG. 9*b*, providing a flat bottom of the barrier 400 to facilitate shipping, transport, storage, etc. Once it is ready to be deployed, the barrier 400 is lifted, the third stanchions 406 rotated down, and the ballast member 407 installed.

Figure 9C:
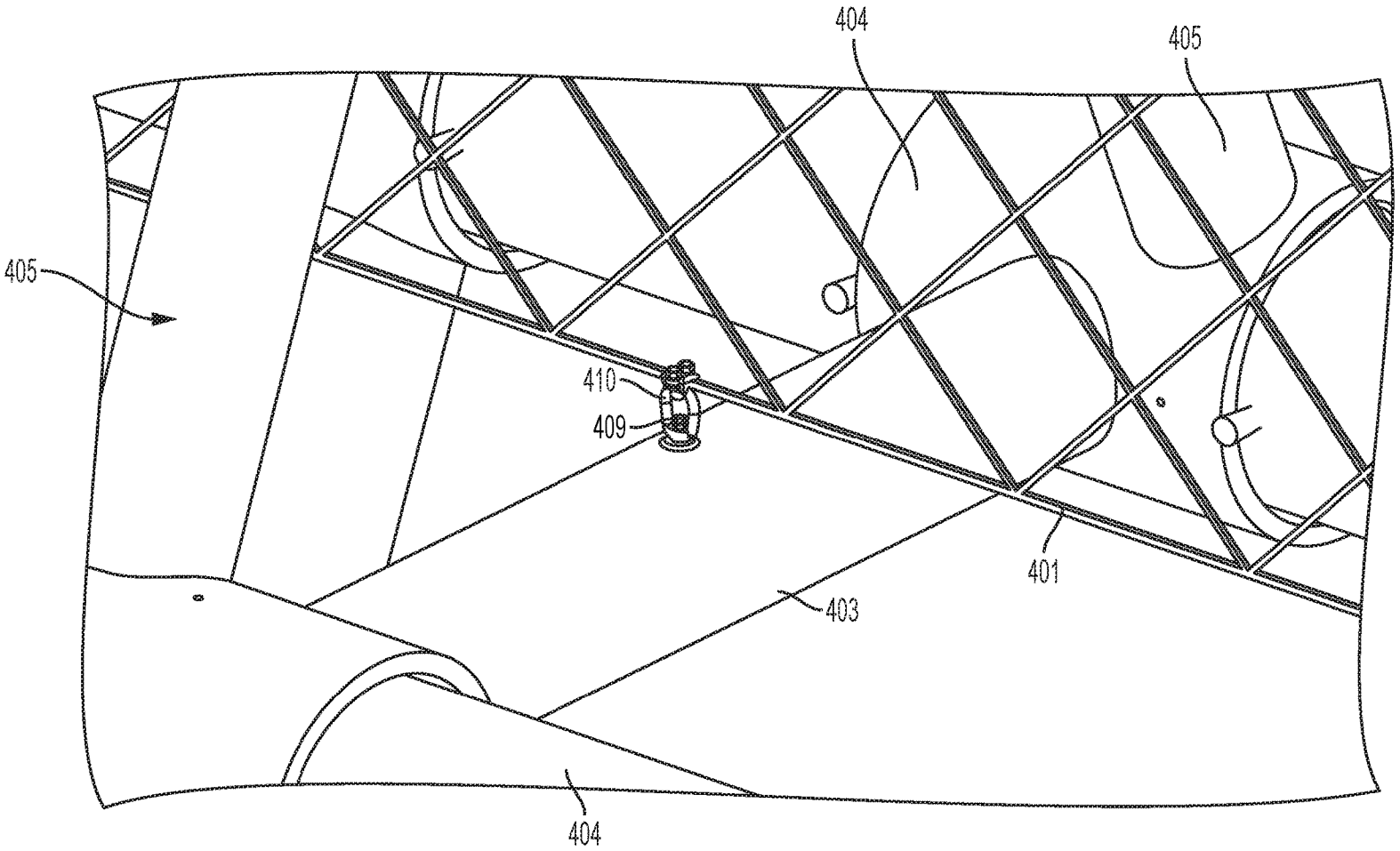
FIGS. 9*c-d* are partial perspective views of net attachment techniques usable with the barrier of FIG. 9*a*.
Figure 9D:
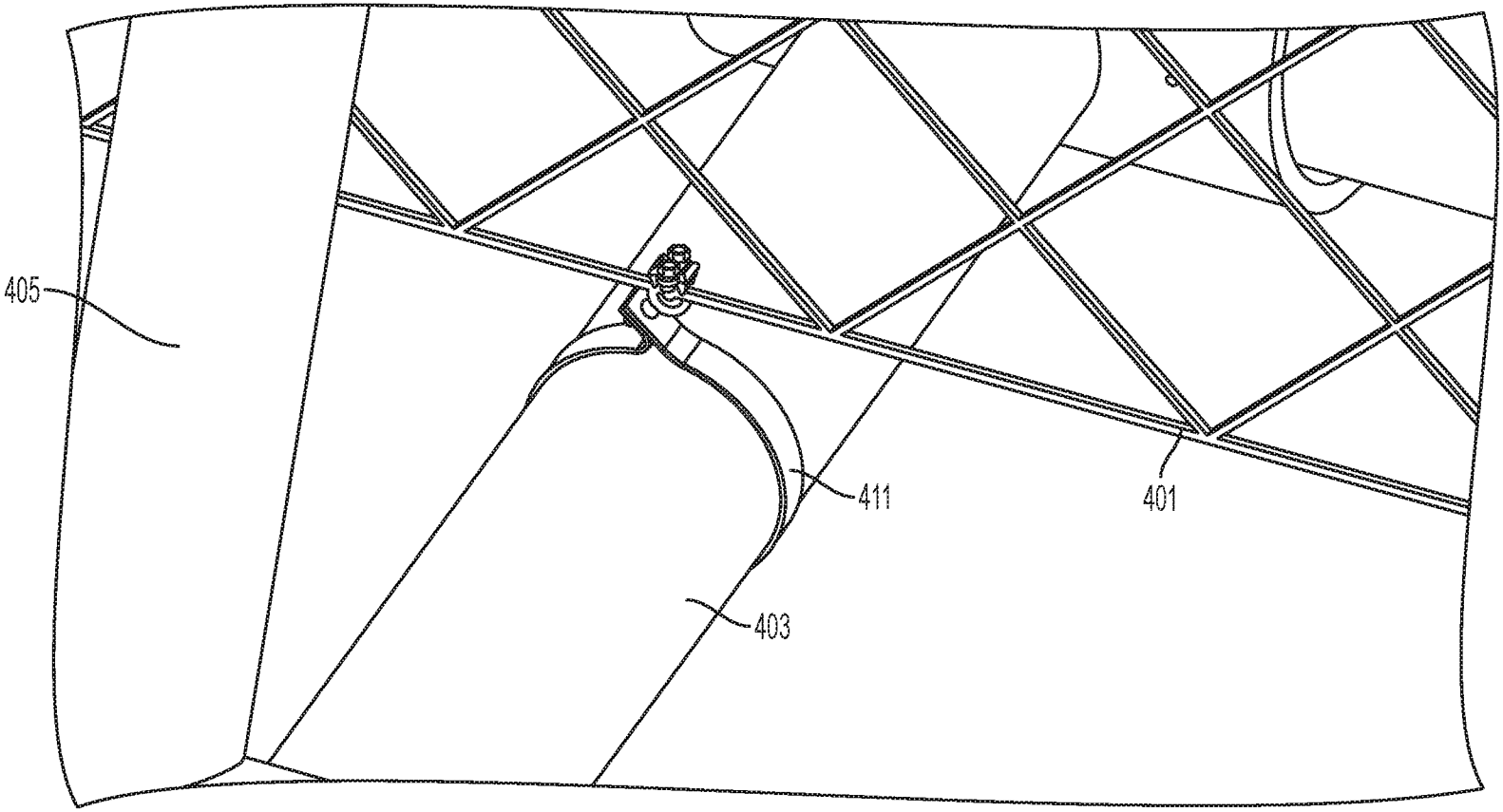

As shown in FIG. 9*a*, the impact net 401 is attached to the net support member 402 by a plurality of pipe bands 115 surrounding the net support member 402 as described above with reference to FIG. 5*a*, and also by a plurality of brackets 116 attached to the trusses 408 as described above with reference to FIGS. 5*b*-*c*. Referring now to FIG. 9*c*, the lower part of the net 401 is attached to the middle of the first stanchions 403 using a bolt or pin 409, such as comprising stainless steel, run through the first stanchion 403. The net 401 is secured to the end of the bolt 409 with a wire rope clip, eye nut, or a similar arrangement 410. Alternatively, as shown in FIG. 9*d*, the net 401 can be secured to a stainless steel pipe hanger 411 that wraps around the first stanchion 403, similarly to the pipe band technique of FIG. 5*a*.

Figure 10:
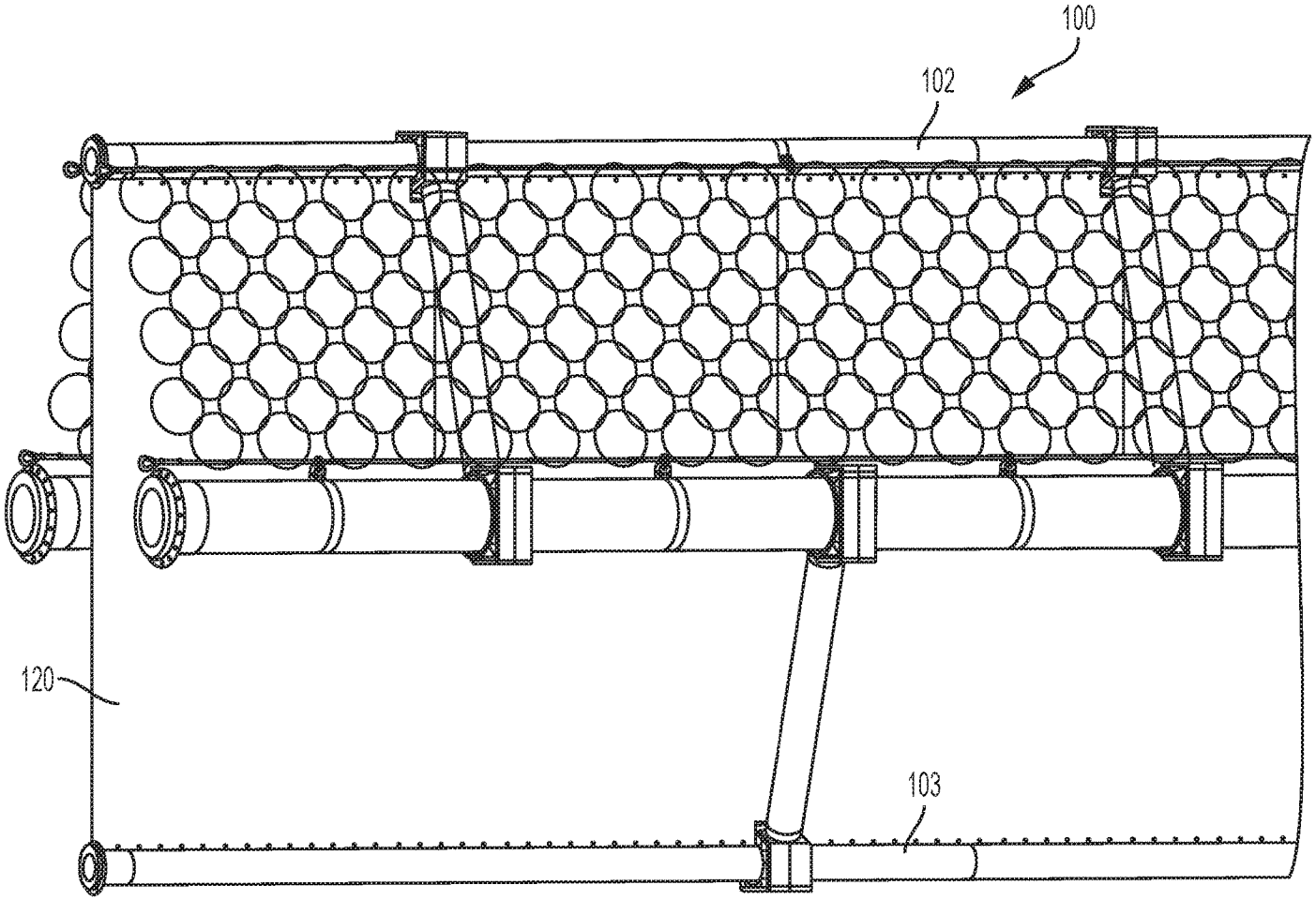
FIG. 10 is a partial perspective view of the barrier of FIG. 1*a* with an oil containment boom attached.

FIG. 10 illustrates the barrier 100 of FIG. 1*a* with an oil containment boom 120 attached between the net support member 102 and the lower ballast member 103, which can be added to the system (always deployed or deployed as needed) to help contain spills. The boom 120 is made from commercial off-the-shelf (COTS) oil containment material and is secured to the pipes 102, 103 at existing grommet locations using; e.g., the wire rope and shackle technique shown in FIG. 5*a*. Those of skill in the art will understand the boom 120 is also attachable to any of the other embodiments of the barrier disclosed herein, except for the embodiments that do not have a lower ballast member.

A further embodiment of a marine barrier according to the present disclosure will now be described, having a single net extending from an upper net support (such as an HDPE pipe) to a lower net support (such as another HDPE pipe) below the pair of buoyant members. It can include composite or steel stanchions to support all four pipes (as opposed to the stanchions and trusses of the previous embodiments, which supported two or three pipes).

Referring now to FIGS. 12-16, a marine barrier 500 comprises two substantially parallel elongate buoyant members 501, such as HDPE pipe, spaced apart from each other. An elongate upper net support member 502, such as HDPE pipe, is spaced from the buoyant members 501, disposed between the two buoyant members 501 and above the buoyant members 501 when the buoyant members are floating in a body of water. An elongate lower net support member 503, such as HDPE pipe, is spaced from the buoyant members 501, disposed between the buoyant members 501 and below the buoyant members 501 when the buoyant members are floating in the body of water.

Figure 15:
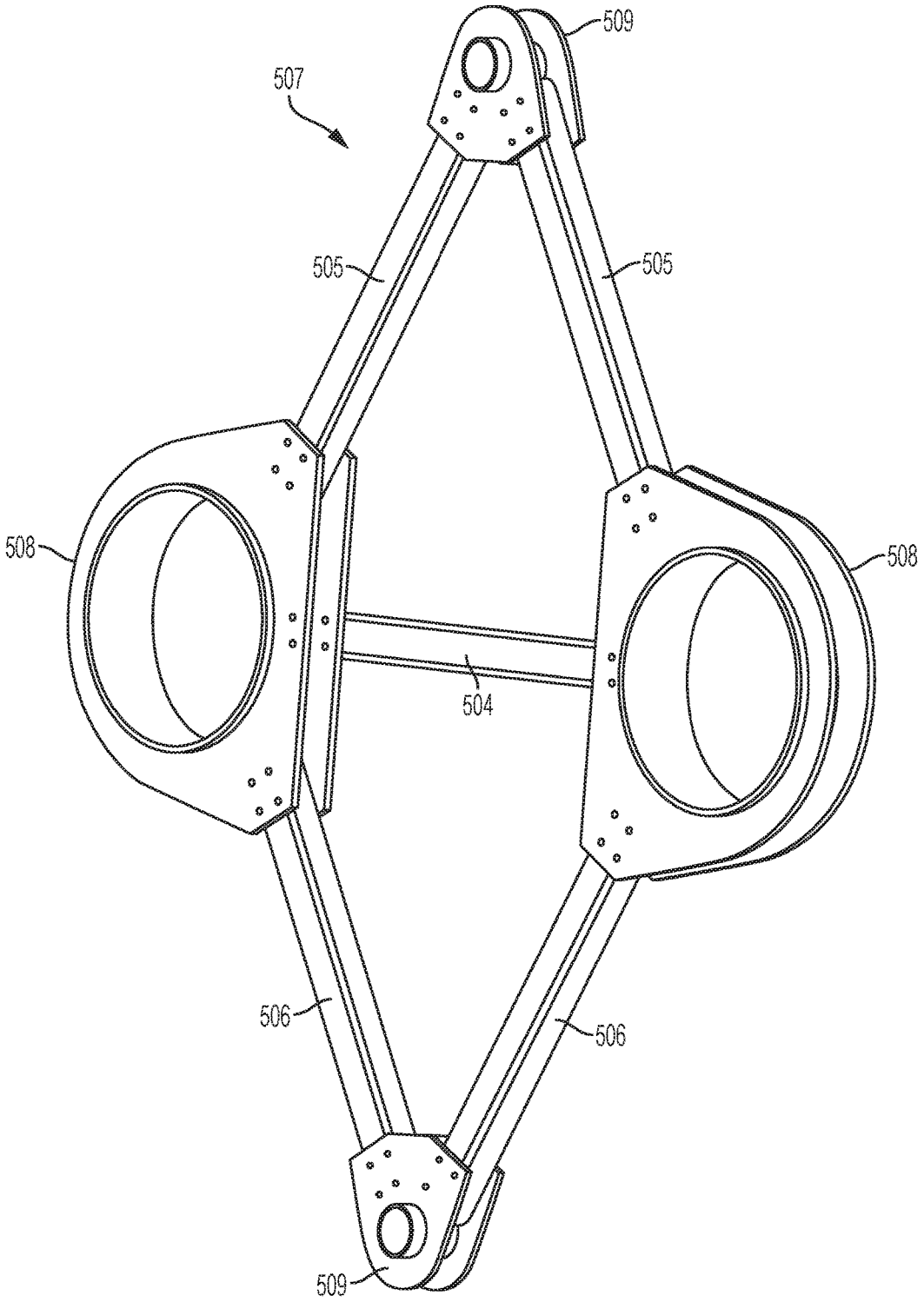
FIG. 15 illustrates a stanchion of the barrier of FIG. 12.
Figure 16:
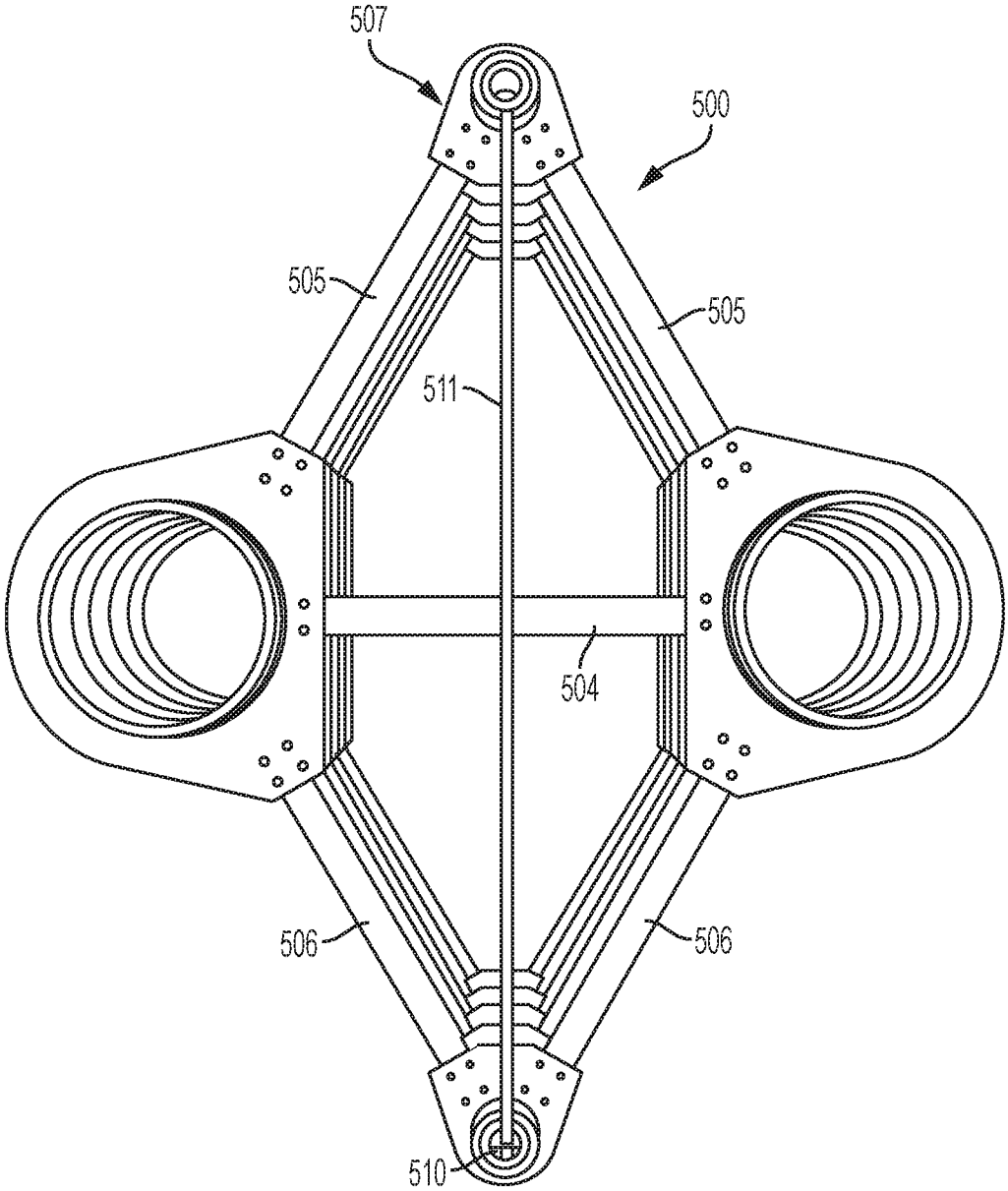
FIG. 16 is an end view of the barrier of FIG. 12.

A plurality of substantially rigid first stanchions 504 extend between the two buoyant members 501 to maintain the spacing between the buoyant members. A plurality of substantially rigid second stanchions 505 each extend between one of the buoyant members 101 and the upper net support member 502 to maintain the spacing between the buoyant members 101 and the upper net support member 502. A plurality of substantially rigid third stanchions 506 each extend between one of the buoyant members 101 and the lower net support member 503 to maintain the spacing between the buoyant members 501 and the lower net support member 503. As in the above-described embodiments, the stanchions 504, 505, 506 can each be separate stanchions as shown in FIG. 6*c*, or can be combined into a truss having three pipes as shown in FIGS. 6*a* and 6*b*. Alternatively, a truss 507 is provided that includes five stanchions 504, 505, 506, as best shown in FIG. 15. In certain embodiments, the stanchions 504, 505, 506 are made of molded HDPE connectors and HDPE pipe. In other embodiments, the stanchions 504, 505, 506 comprise galvanized steel or fiber reinforced plastic (FRP) composite material, such as vinylester.

In the embodiment of FIGS. 12-16, the stanchions 504, 505, 506 are galvanized steel box beams, and the truss 507 is formed by five of the stanchions 504, 505, 506 joined together by joints 508, 509 of galvanized steel plates, as by welding (see FIG. 15). More particularly, one of the plurality of first stanchions 504, one of the plurality of second stanchions 505 extending between the first one of the buoyant members 501 and the upper net support member 502, another one of the plurality of second stanchions 505 extending between a second one of the buoyant members 501 and the upper net support member 502, one of the plurality of third stanchions 506 extending between the first one of the buoyant members 101 and the lower net support member 503, and another one of the plurality of third stanchions 506 extending between the second one of the buoyant members 501 and the lower net support member 503 are attached to each other.

The lower net support member 503 comprises ballast 510 (see FIG. 16), such as the chain 104 shown in FIG. 11, having sufficient weight to provide a restoring force to restore the barrier 500 to an upright position when the buoyant members 501 are floating in a body of water and the barrier 500 rotates from the upright position, as discussed herein above with reference to FIGS. 3*a-c*. For example, the ballast 510 provides the restoring force when the barrier 500 rotates up to 135 degrees from vertical.

Figure 13:
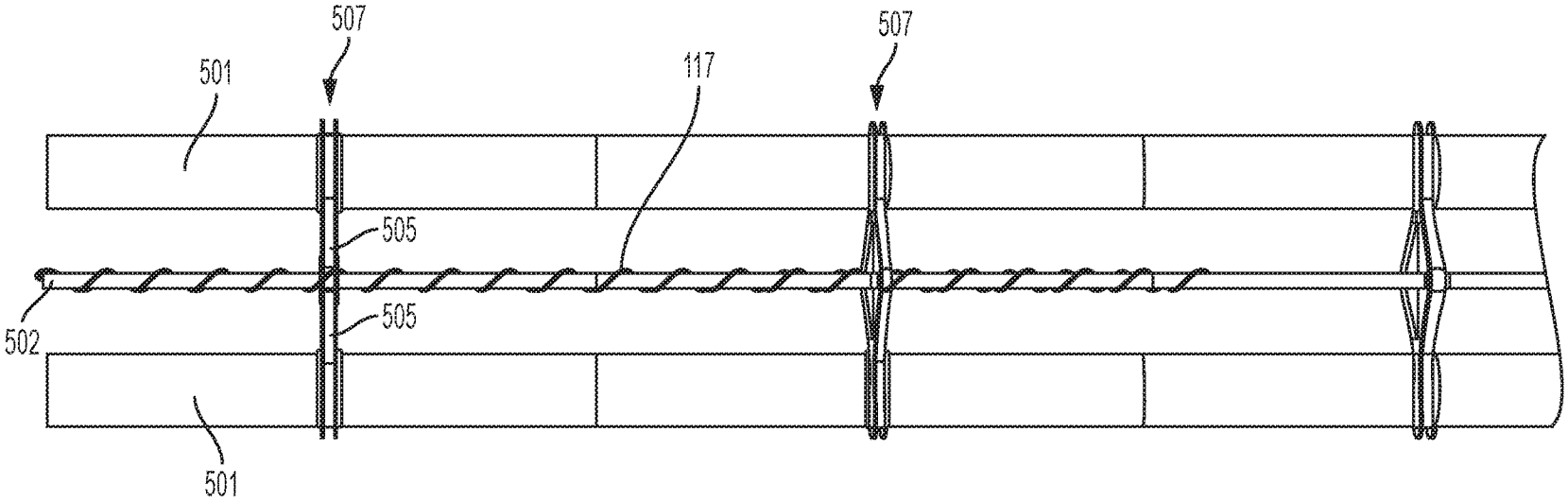
FIG. 13 is a partial top view of the barrier of FIG. 12.
Figure 14:
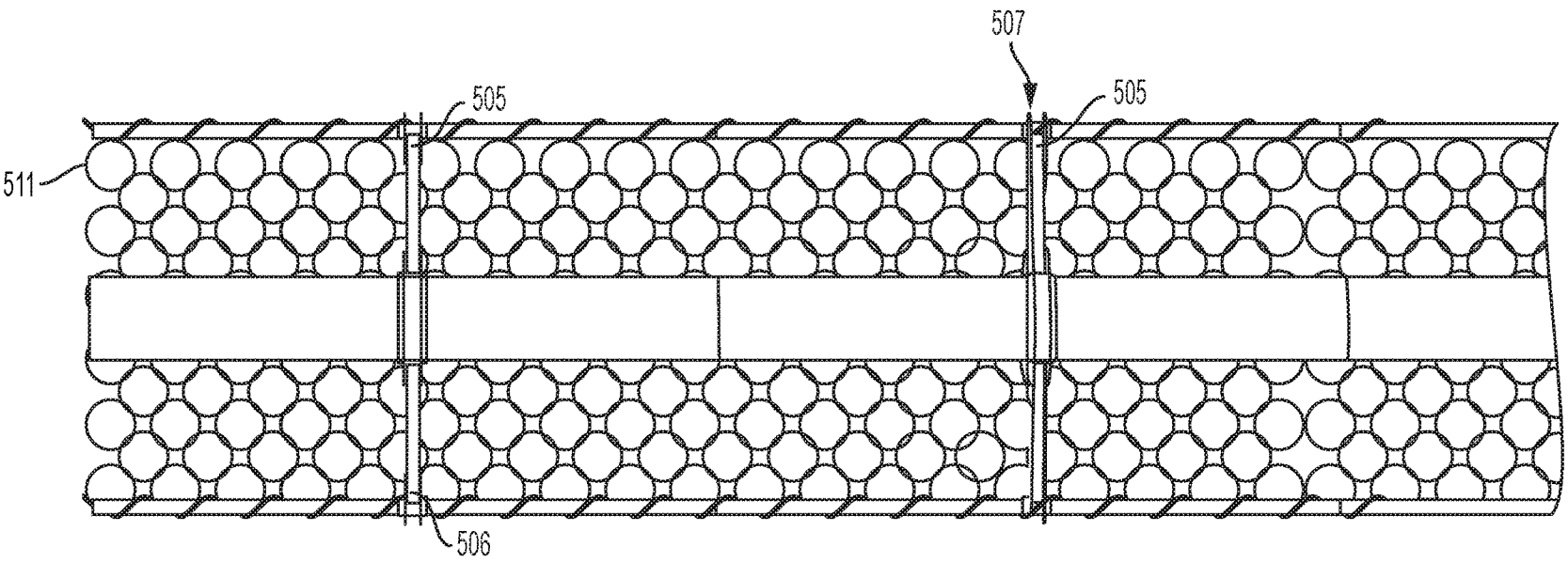
FIG. 14 is a partial side view of the barrier of FIG. 12.

An impact net 511 is attached to the upper net support member 502 and the lower net support member 503, such that when the buoyant members 501 are floating in the body of water and a moving vessel V impacts the impact net 511, the impact net 511 deflects to transfer a force of the impact to one or more of the net support members 502, 503, the first stanchions 504, the second stanchions 505, the third stanchions 506, and the buoyant members 501, and the buoyant members 501 in turn engage the water to transfer the force of the impact to the water and arrest the motion of the vessel V. The impact net 511 can comprise any of the materials discussed herein above, such as metal rings, metal rope, or a polymer net. The net 511 is attached to the net support members 502, 503 in certain embodiments via wire rope 114 and pipe bands 115, as shown in FIG. 5*a*, or by brackets 116 as shown in FIGS. 5*b-c*, or by looped wire 117, as shown in FIGS. 12-13 (i.e., each net support member 502, 503 has a stainless steel wire 117 looped around it which engages an outer portion of the net 511).

The dimensions of the barrier 500 of this embodiment (i.e., height, draft, beam) are similar to those of the barrier of FIG. 2*b*, disclosed herein above. Thus, when vessel V impacts the barrier of FIGS. 12-16, the forces are transferred as follows. Due to the barrier height versus bow height of a vessel within the 99% energy threshold discussed above with reference to FIG. 2*b*, the bow of the vessel V will engage the single impact net 511. The net will engage and deform around the bow of the vessel V prior to the vessel coming in contact with the pipes 501, 502, 503. Referring to FIG. 12, the net 511 then undergoes plastic deformation, elongating and thereby absorbing energy. During the impact process, the net 511 also dissipates energy to the water as the barrier 500 is dragged through the water. It also transfers force to the net connection points to the stanchions 504, 505, 506 and the buoyant members 501 (see arrows X, Y, and Z). These then drag through the water, absorbing the remaining energy (see arrow M). Energy can be transferred down to the mooring, if impacted at a mooring location; however, the net 511 is sized to absorb the full load of the vessel V.

Figure 17:
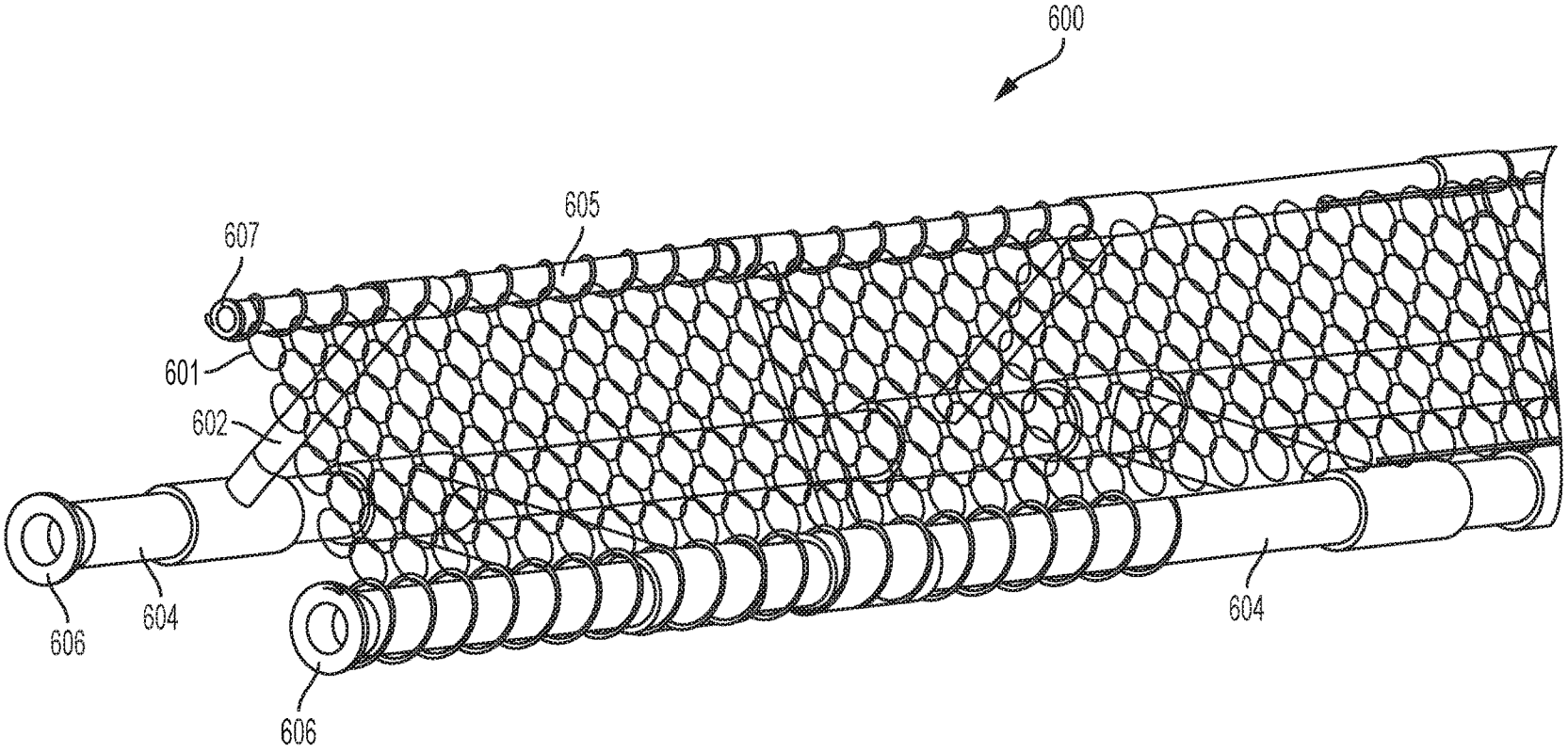
FIG. 17 is a perspective view of another embodiment of a marine barrier according to the present disclosure.
Figure 18:
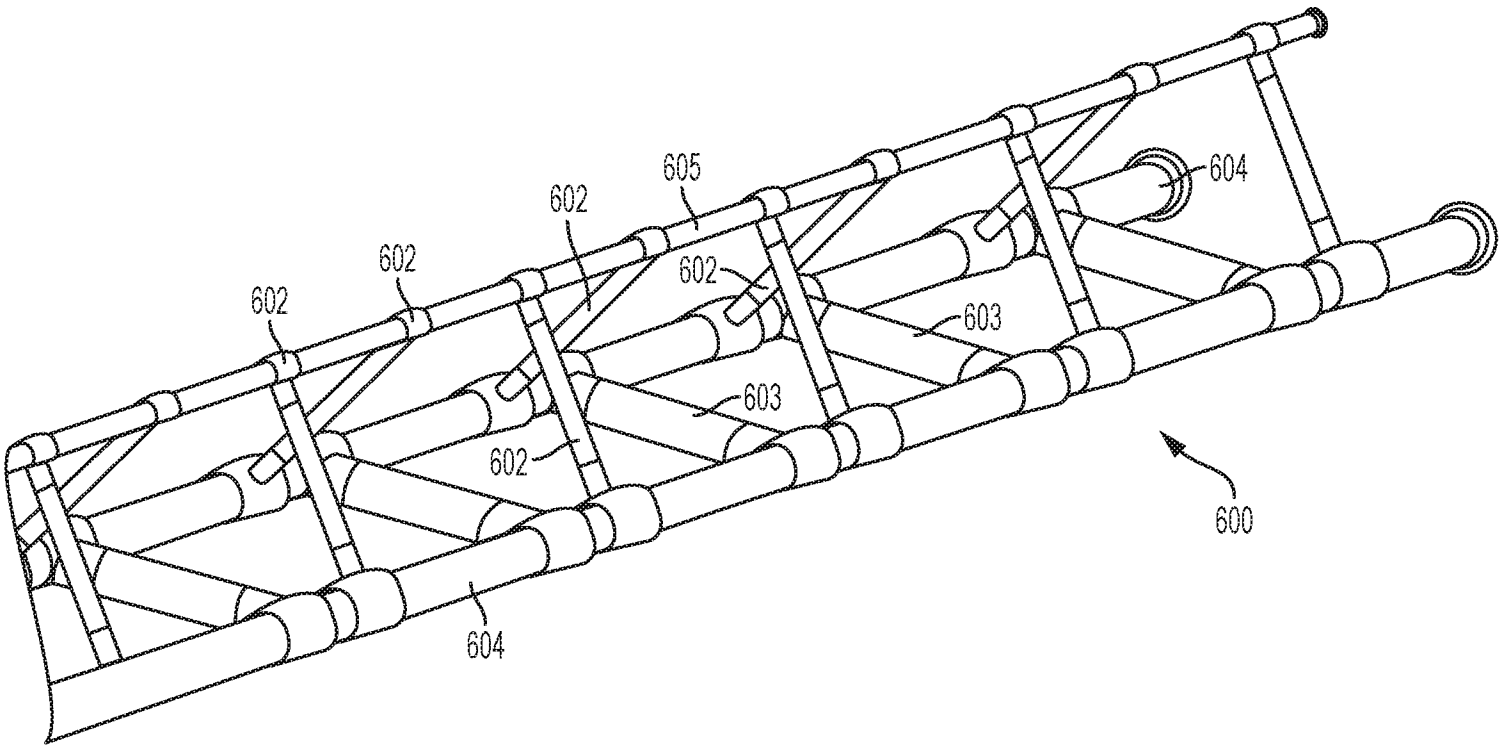
FIG. 18 is a partial perspective view of the barrier of FIG. 17 without the net attached.

FIGS. 17 and 18 illustrate another embodiment of a marine barrier 600 according to the present disclosure, similar to the barrier of FIG. 8 described above, which has a single net 601 and does not have a lower ballast member. In this embodiment, as best seen in FIG. 18 showing the barrier 600 with the net 601 removed for clarity, each stanchion 602, 603 connects only two pipes, as in the stanchion 406 of FIG. 6*c*. In particular, the stanchions 602 connect a net support member 605 to one of a pair of buoyant members 604, and stanchions 603 connect the buoyant members 604 to each other. The plurality of stanchions 602, 603 are sequentially spaced to support all three pipes 604, 605. Those of skilled in the art will understand that a lower ballast member (i.e., a fourth pipe) can be added if needed, supported by additional stanchions (not shown). This embodiment can include any net attachment technique discussed herein above, such as wire rope 114 and pipe bands 115, as shown in FIG. 5*a*, brackets 116 as shown in FIGS. 5*b-c*, or looped wire 117, as shown in FIG. 12 (i.e., a stainless steel wire 117 looped around the net support member engages an outer portion of the net). The barrier 600 also has flanged end connections 606, 607 as discussed herein above.

Figure 19:
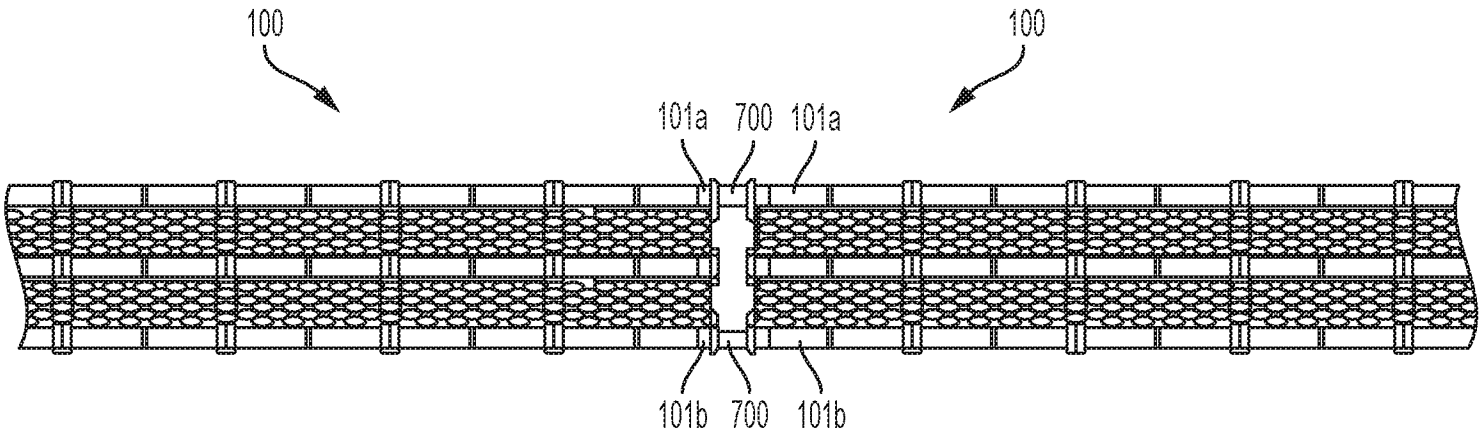
FIG. 19 is a partial top view showing two of the disclosed barrier units joined together by hinge joints according to the present disclosure.

As discussed herein above, the ends of each disclosed barrier unit 100, 200, 300, 400, 500, 600 have flanged connections, as shown in FIG. 4, to attach to other lengths of barrier or end connections. Thus, barrier units can be joined to each other end-to-end, as by bolting together using standard flange adapters. In further alternative embodiments, any of the barriers disclosed above can include two or more barrier units having elastic hinge joints attached between the flanged connections at corresponding ends of their respective buoyant members. An example of such an assembly is shown in FIG. 19, which is a top view of two of the barrier units 100 of FIG. 1*a* joined end-to-end by a first elastic hinge joint 700 attached to the first end of the first one of the buoyant members 101*a* and attached to the corresponding first end of a first one of the buoyant members 101*a* of the second barrier 100, and a second elastic hinge joint 700 attached to the first end of the second one of the buoyant members 101*b* and attached to the corresponding first end of a second one of the buoyant members 101*b* of the second barrier 100. Note that in such embodiments, the upper and lower net support members and/or lower ballast member of each barrier unit are not attached to each other.

Details of the elastic hinge joints 700 are shown in FIGS. 2*a-c*. The hinge joint 700 has a molded elastic core 701 comprising; for example, EPDM rubber with a Durometer value of about 60 to about 70. A stainless steel ring assembly 702 is molded to each end of the elastic core 701 to form the elastic hinge joint 700. The ring assembly 702 consists of 3 main components: 1) a round bar 702*a* embedded into the hinge joint 700 that grips and holds onto the elastic material 701 when the hinge joint 700 is being elongated; 2) a backing plate 702*b* that provides support when the hinge joint 700 is compressed; and 3) threaded studs 702*c* that mate to the flanged connections (e.g., connections 101*aa*, 101*ba* shown in FIG. 4) on the ends of the buoyant members. All three of these parts 702*a-c* are welded together into a single unit 702.

Figure 20A:
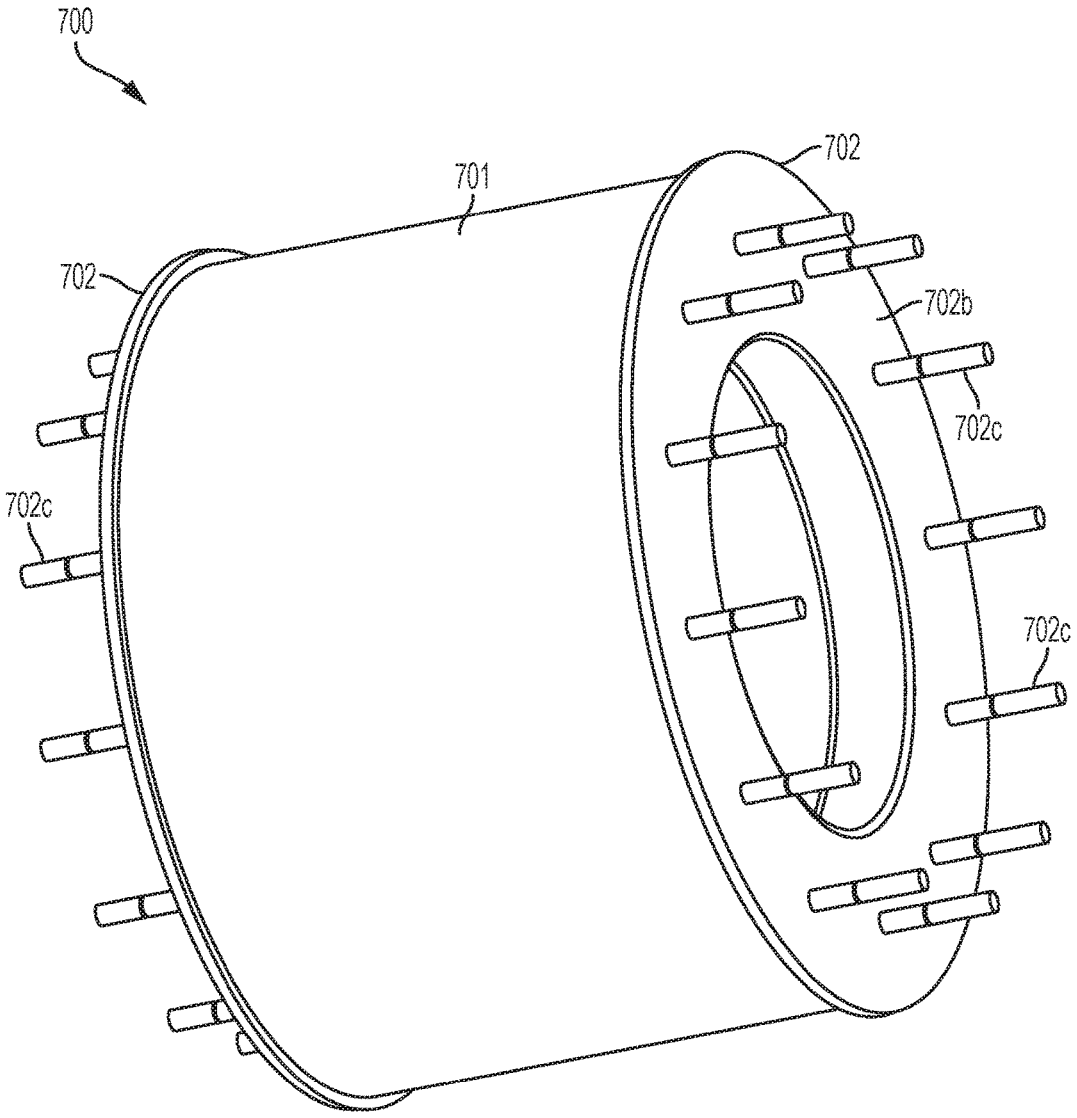
FIGS. 20*a-c* are a perspective view, a side view, and an exploded view, respectively, of a hinge joint according to the present disclosure.
Figure 20B:
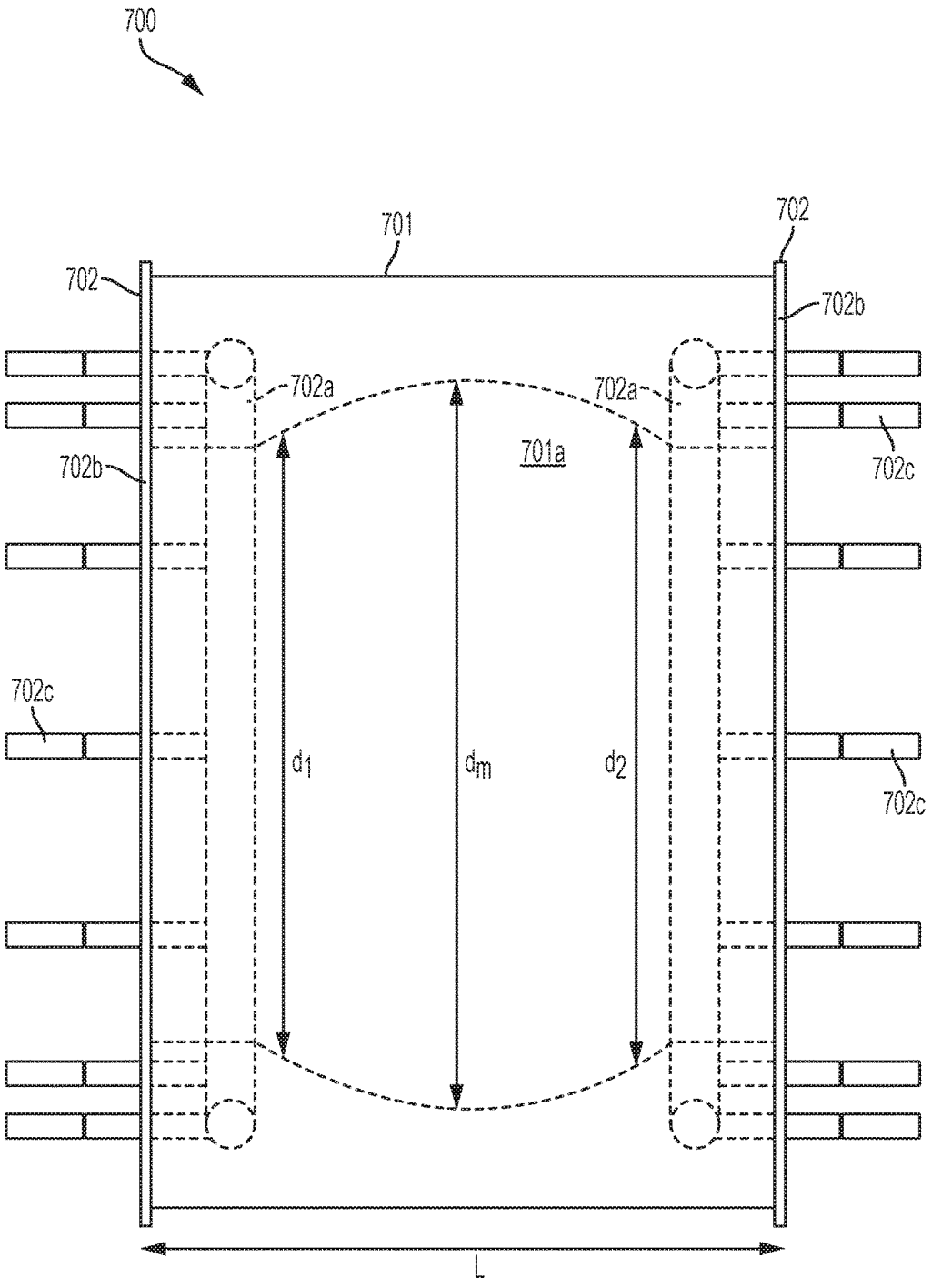
Figure 20C:
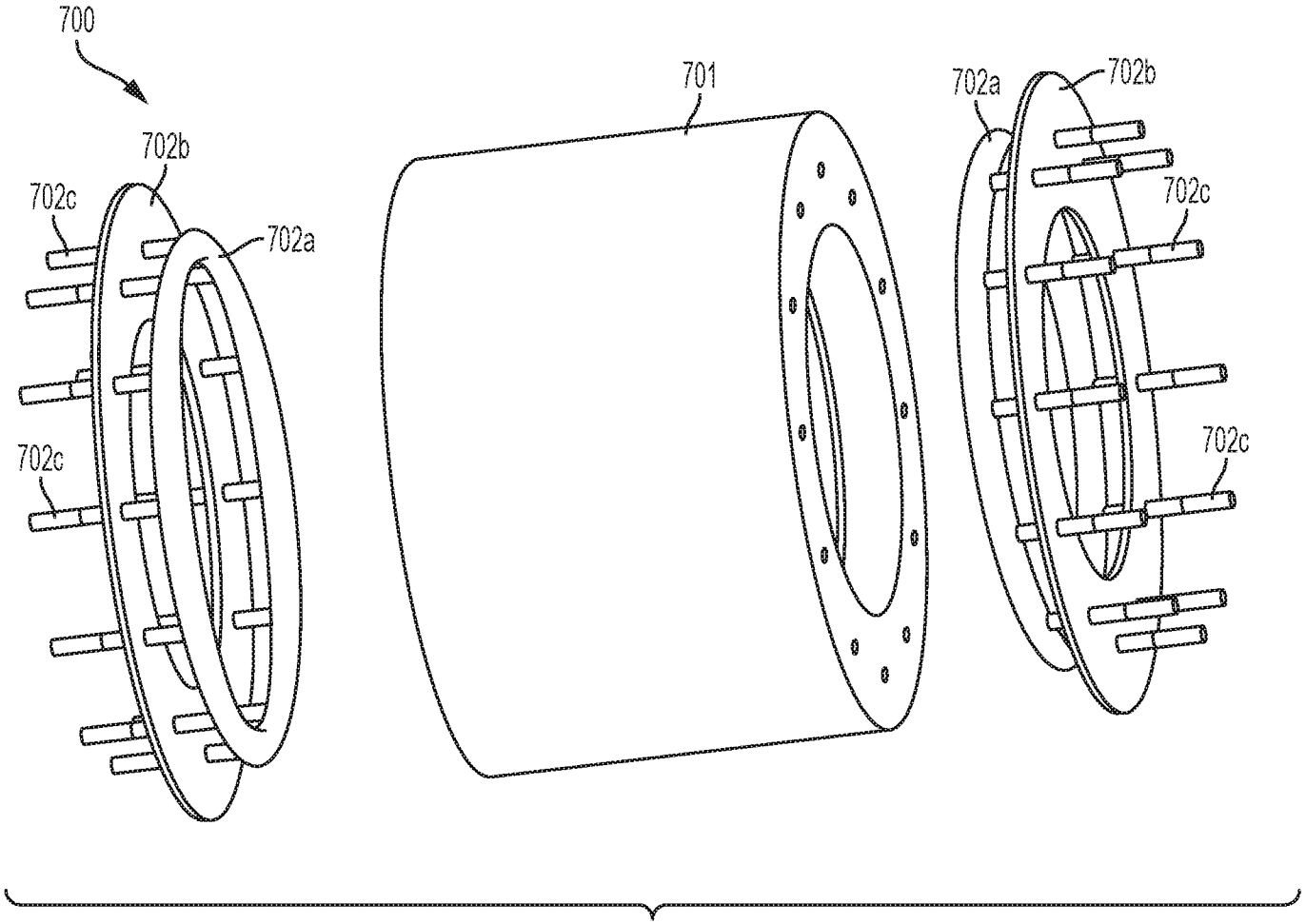

The elastic core 701 is cylindrical, and its interior 701*a* has an inside diameter that varies from the ends of the elastic core to the middle of the core, as best shown in FIG. 20*b*. Generally, the diameter of the open space within the core is less at the ends than in the middle; thus, diameter $d_m$ at the middle of the interior 701 is larger than diameter $d_1$ or $d_2$ near the ends of the interior 701. This allows the hinge joint 700 an elasticity such that it is axially expandable and compressible by at least 20%; e.g., the hinge joint 700 can expand and compress between 20-30% of its length L. This axial stiffness or elasticity is advantageous as it allows the first and second hinge joints 700 to work together. For example, when the barrier of FIG. 19 is subjected to broadside loading due to wind, waves, and/or current, it will form a catenary. This causes the "windward" buoyant members (e.g., 101*a*) to compress one of the hinge joints 700 while the other "leeward" hinge joint 700 expands (i.e., elongates). The 20-30% elasticity value insures that the hinge joints 700 will provide all necessary deformation up to a 10 meter wave event.

The bending stiffness of the hinge joint 700 is also important, and is determined by a combination of the hinge joint's geometry and rubber core 701 properties. In some embodiments, the hinge joints' bending stiffness is between 1/10th and 1/20th of that of the pipes that form the buoyant members 101*a*, 101*b*. The result of this relationship is that parts of the barrier made of different materials and thicknesses work together to provide and maintain structural integrity. When the barrier is subjected to extreme bending deformations, such as in a large wave event, the above-stated ratio of bending stiffnesses insures that the stress is distributed such that the hinge joints 700 do not absorb all the deformation load (as in steel barges with rubber joints, where the steel is always straight and the rubber deforms), nor will the buoyancy members 101*a*, 101*b* see highly located stresses (such as where a steel joint is secured to plastic pipe: the steel won't move, forcing the plastic proximal the steel to bend more).

Figure 21:
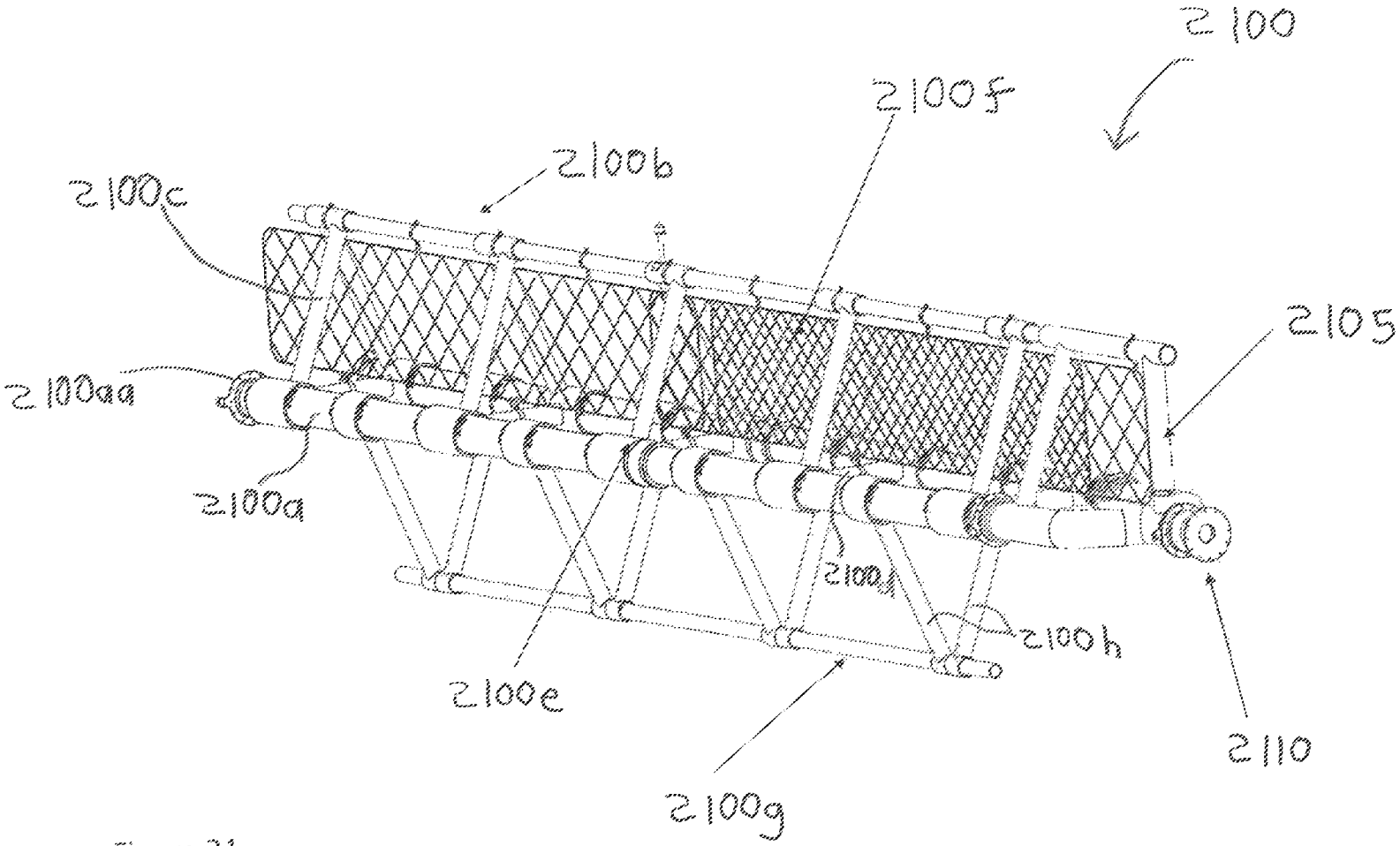
FIG. 21 is a perspective view of the barrier of FIG. 1*a* with a single hinge adapter according to the present disclosure.

In further embodiments shown in FIGS. 21-23, a marine barrier includes an adapter assembly attached to each opposing end of each of its barrier units to allow for a single elastic hinge joint to be the primary connection between two adjacent barrier units. Referring now to FIGS. 21, 22 and 23, the open water barrier unit 2100 shown in these figures is similar or identical to barriers previously described; for example, with reference to FIGS. 1*a*, 9*a*, 17*a*, etc. Accordingly, exemplary barrier unit 2100 includes a pair of buoyant members 2100*a*, and a net support member 2100*b* spaced from each other via stanchions 2100*c*, 2100*d* that can be attached to each other to form trusses 2100*e*. An impact net 2100*f* is attached to the net support member 2100*b* and the trusses 2100*e*. Barrier unit 2100 further can include a lower ballast member 2100*g* spaced from the buoyant members 2100*a* via stanchions 2100*h*.

Figure 22A:
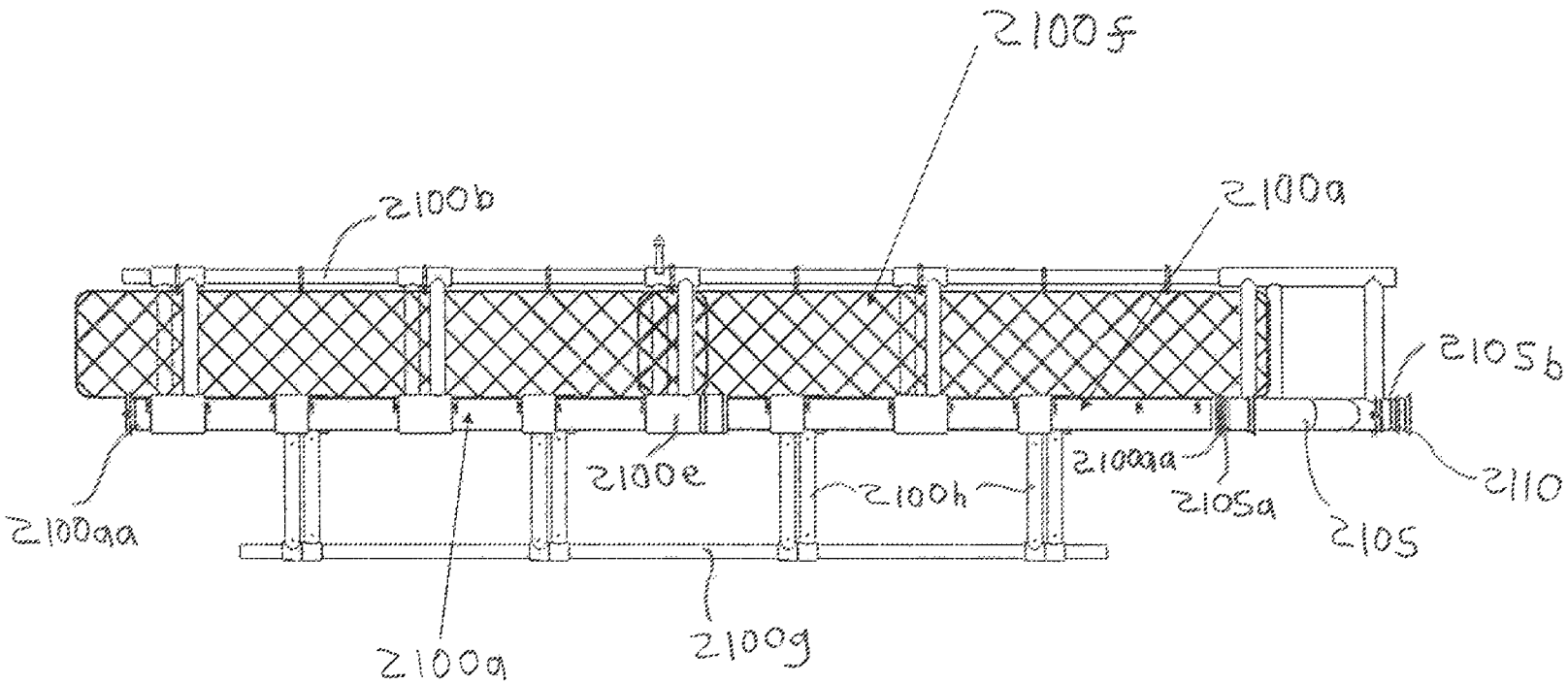
FIGS. 22*a-b* are a side view and an end view, respectively, of the barrier of FIG. 21.
Figure 22B:
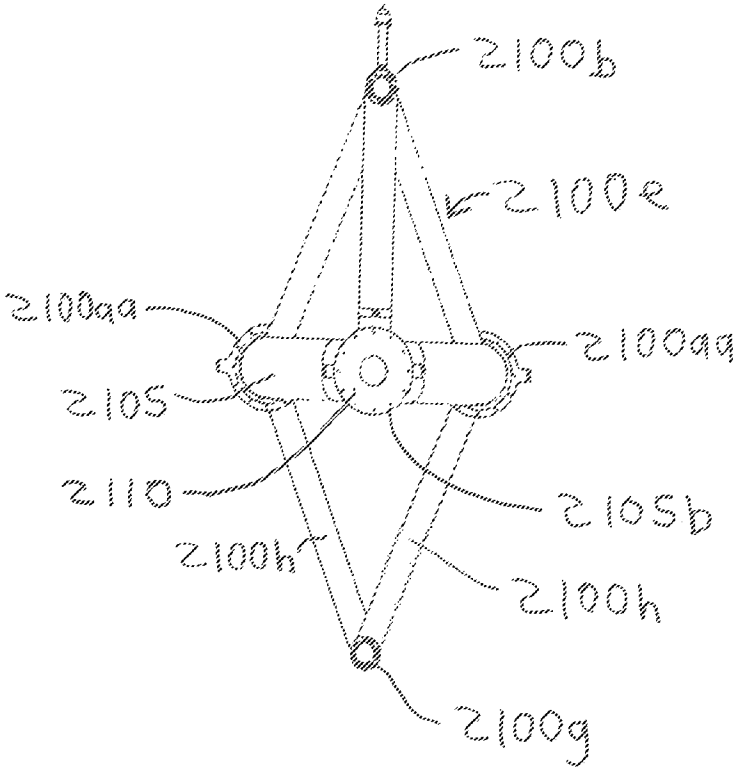

A hinge adapter 2105 is secured to an end of the barrier unit 2100 (see, FIG. 21) to allow successive barrier units 2100 to be attached to each other with a single elastic hinge 2110 between them. FIGS. 22*a-b* respectively show side and end views of barrier unit 2100 (with the impact net 2100*f* around the hinge adapter 2105 removed for clarity). The adapter 2105 is fabricated of HDPE, similar to other components in the barrier. Adapter 2105 is attached via bolted connections 2105*a* to the ends 2100*aa* of buoyant members 2100*a*, similarly to how previously-described hinge joints 700 attach to the ends of the buoyant members of barrier units 100 (see, FIGS. 19 and 20*a*). Adapter 2105 is further attached via a bolted connection 2105*b* to elastic hinge 2110. The load path of this system takes the forces in the buoyant members 2100*a* and feeds them thru the hinge 2110 to the next barrier unit 2100. The overall stability of the barrier is not affected by the addition of the hinge adapter 2105.

Figure 23B:
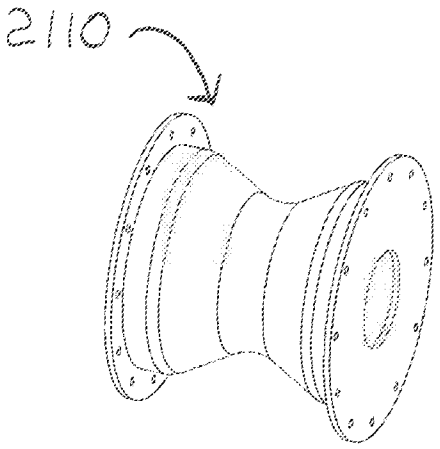
FIG. 23*b* is a perspective view of a hinge joint according to the present disclosure.
Figure 23A:
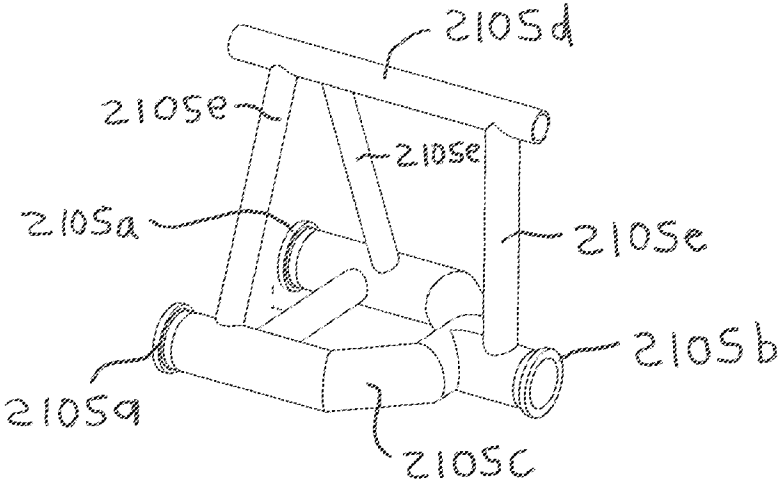
FIG. 23*a* is perspective view of a single hinge adapter according to the present disclosure.

In FIG. 23*a*, an embodiment of the single hinge adapter 2105 is shown in more detail. It is fabricated of HDPE and assembled similar to the trusses shown in previous figures and described herein above. Hinge adapter 2105 of this embodiment includes a Y-shaped lower assembly 2105*c* which carries the bolted connections 2105*a* such that they mate with the ends 2100*aa* of buoyant members 2100*a*, and the bolted connection 2105*b* which mates with elastic hinge 2110. Hinge adapter 2105 further includes an upper adapter member 2105*d* which attaches to the net support member 2100*b*, and stanchions 2105*e* connecting upper adapter member 2105*d* and lower assembly 2105*c*.

Referring now to FIG. 23*b*, the hinge 2110 used in this barrier configuration has a similar durometer as elastic hinge 700 used in previously-described embodiments; however, its geometry is altered to allow for more flexibility around its axis, rather than compressibility, depending on the specific application. For example, those of skill in the art will appreciate that when the barrier is used as a gate, the single hinge 2110 needs to be more flexible than the hinges 700 of previous embodiments, to allow for the extreme operational motion of opening and closing the barrier. Such operational motion includes planar motion; i.e., bending the hinge back on itself, as when a tow vessel swings the barrier to create an open waterway. However, at the same time such a hinge would be very difficult to compress and would instead buckle, due to system geometry and physics. Therefore, a skilled artisan would understand it would not be desirable to design hinge 2110 to be compressible, like hinge 700. Hinge 2110 of this barrier configuration absorbs and transfers all forces associated with the barrier unit 2100 to the next barrier unit. The single hinge configuration of this embodiment is suitable for use in calmer environments where the loads are not as great as those in deeper water and/or more exposed locations.

Figure 26:
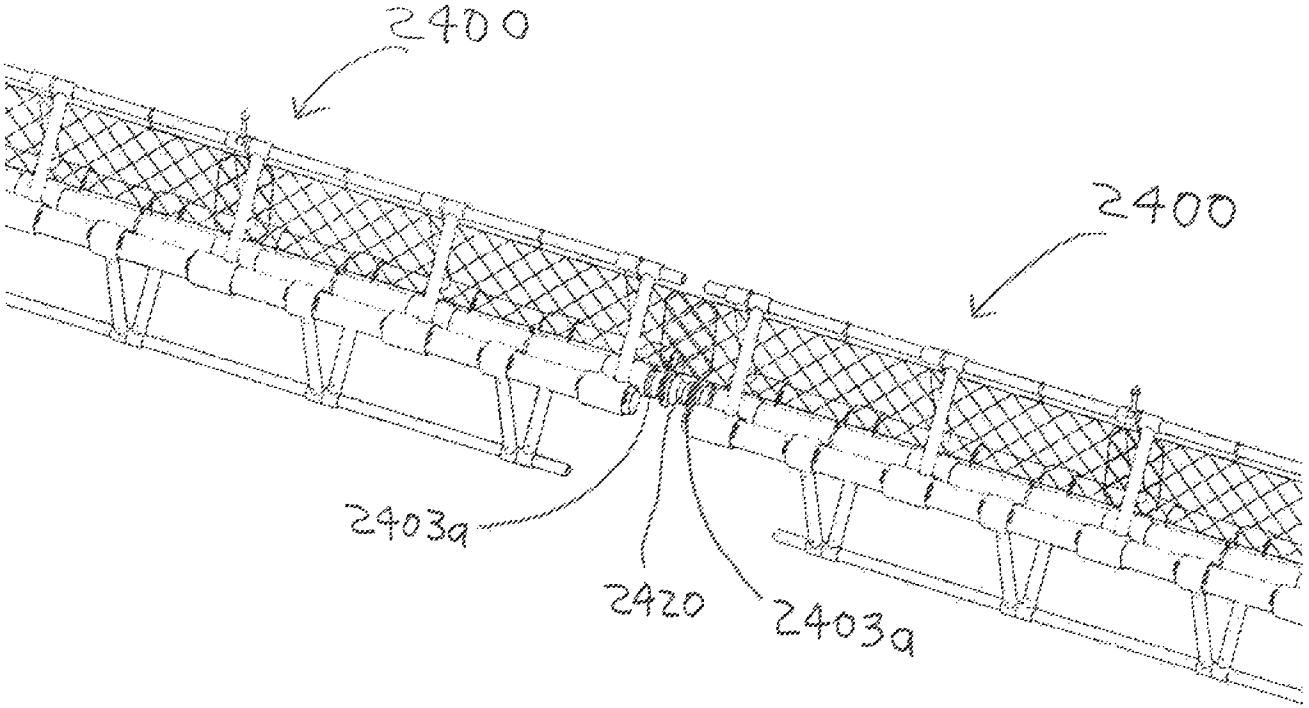
FIG. 26 is a perspective view showing two of the disclosed barrier units of FIG. 24 joined together by a hinge joint according to the present disclosure.
Figure 27:
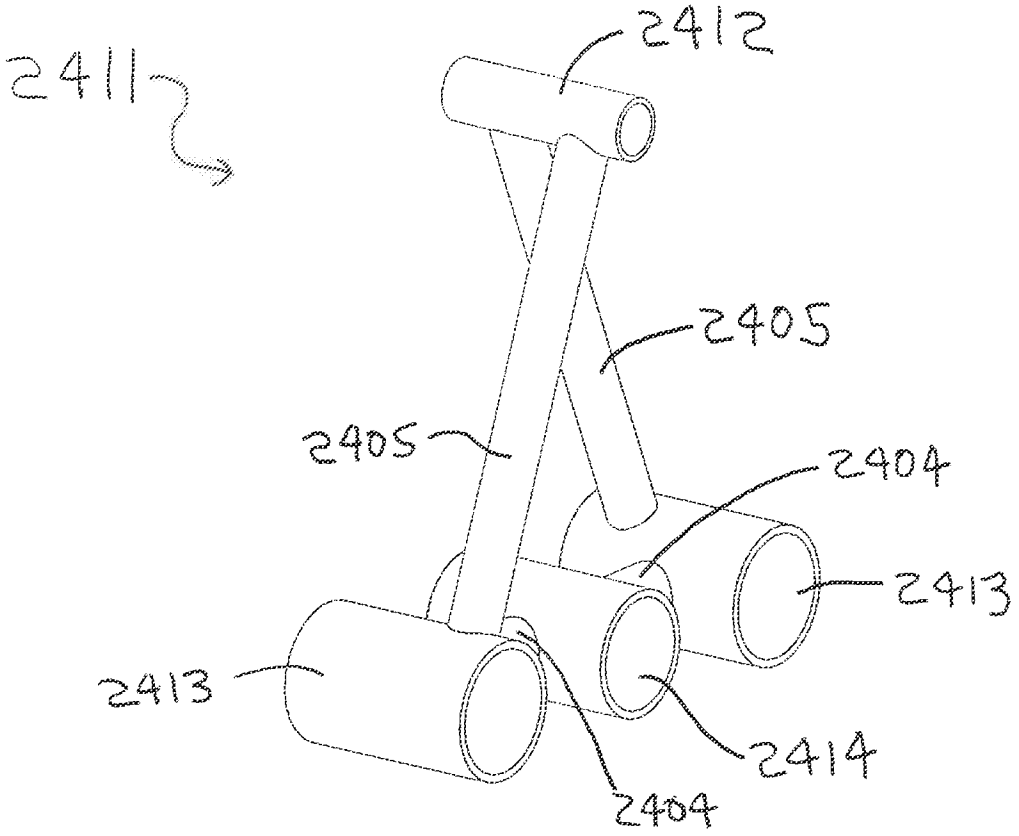
FIG. 27 is a perspective view of a truss of the barrier of FIG. 24.
Figure 28:
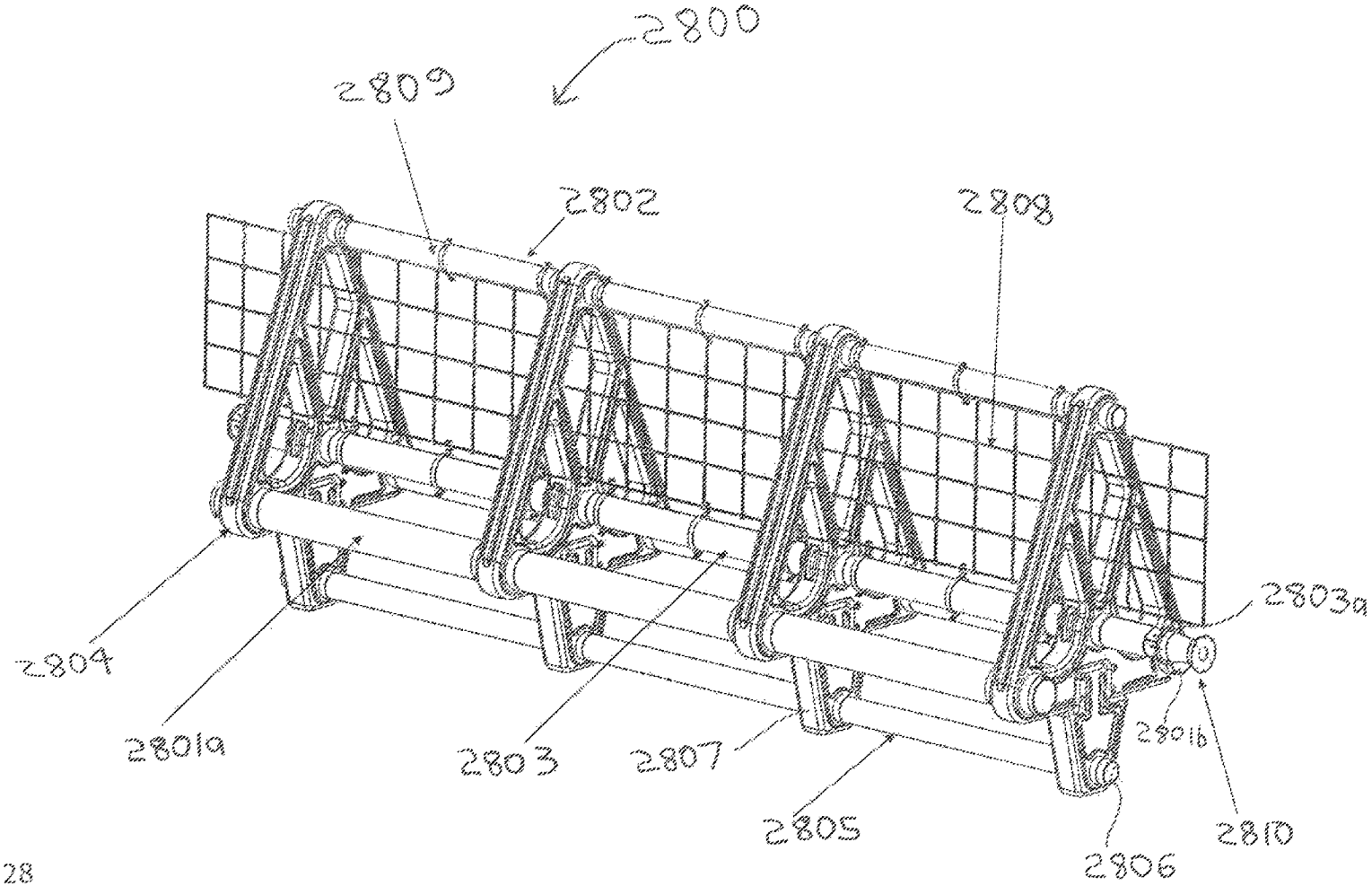
FIG. 28 is a perspective view of a marine barrier according to the present disclosure.
Figure 29A:
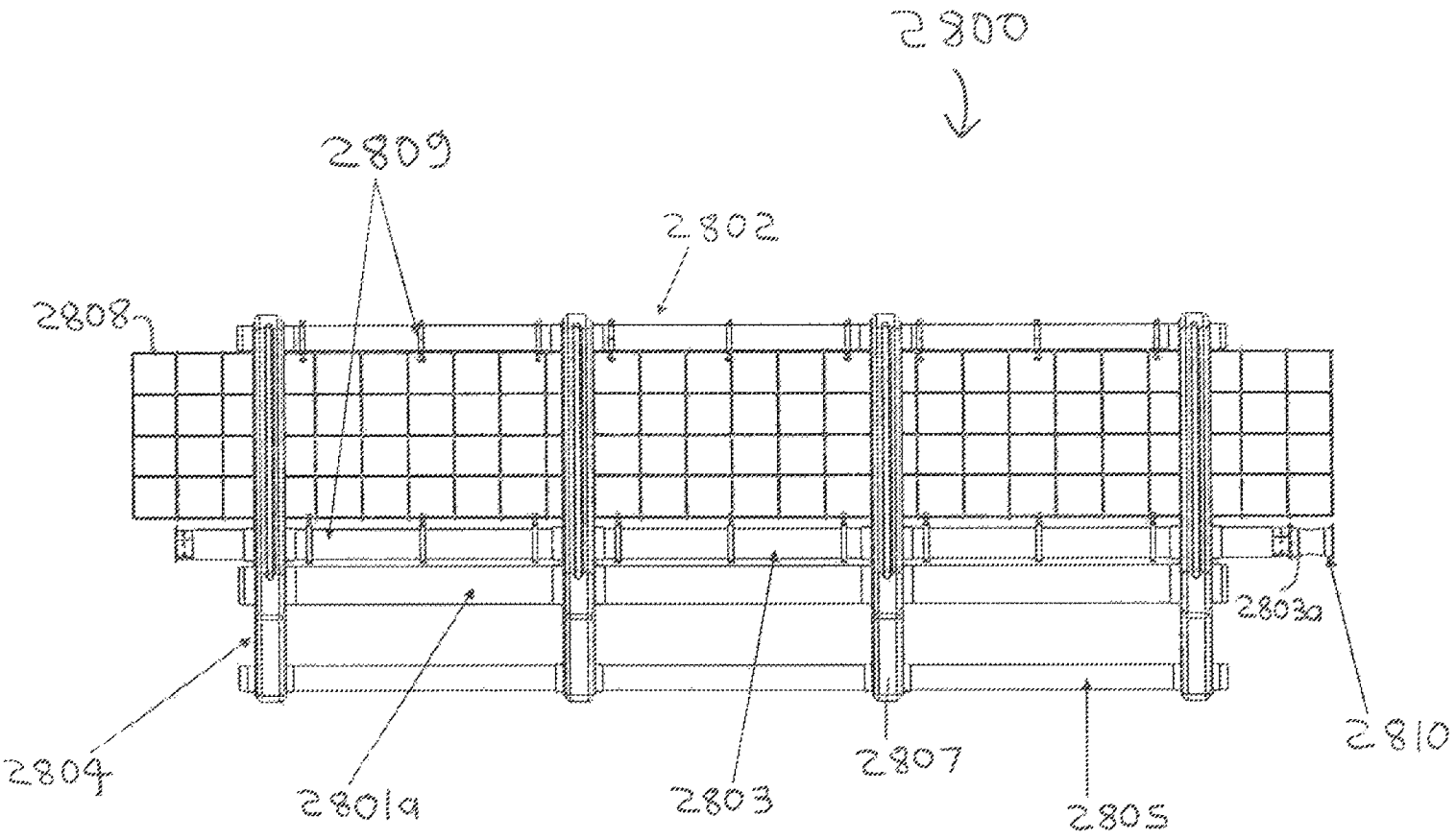
FIGS. 29*a-b* are a side view and an end view, respectively, of the barrier of FIG. 28.
Figure 29B:
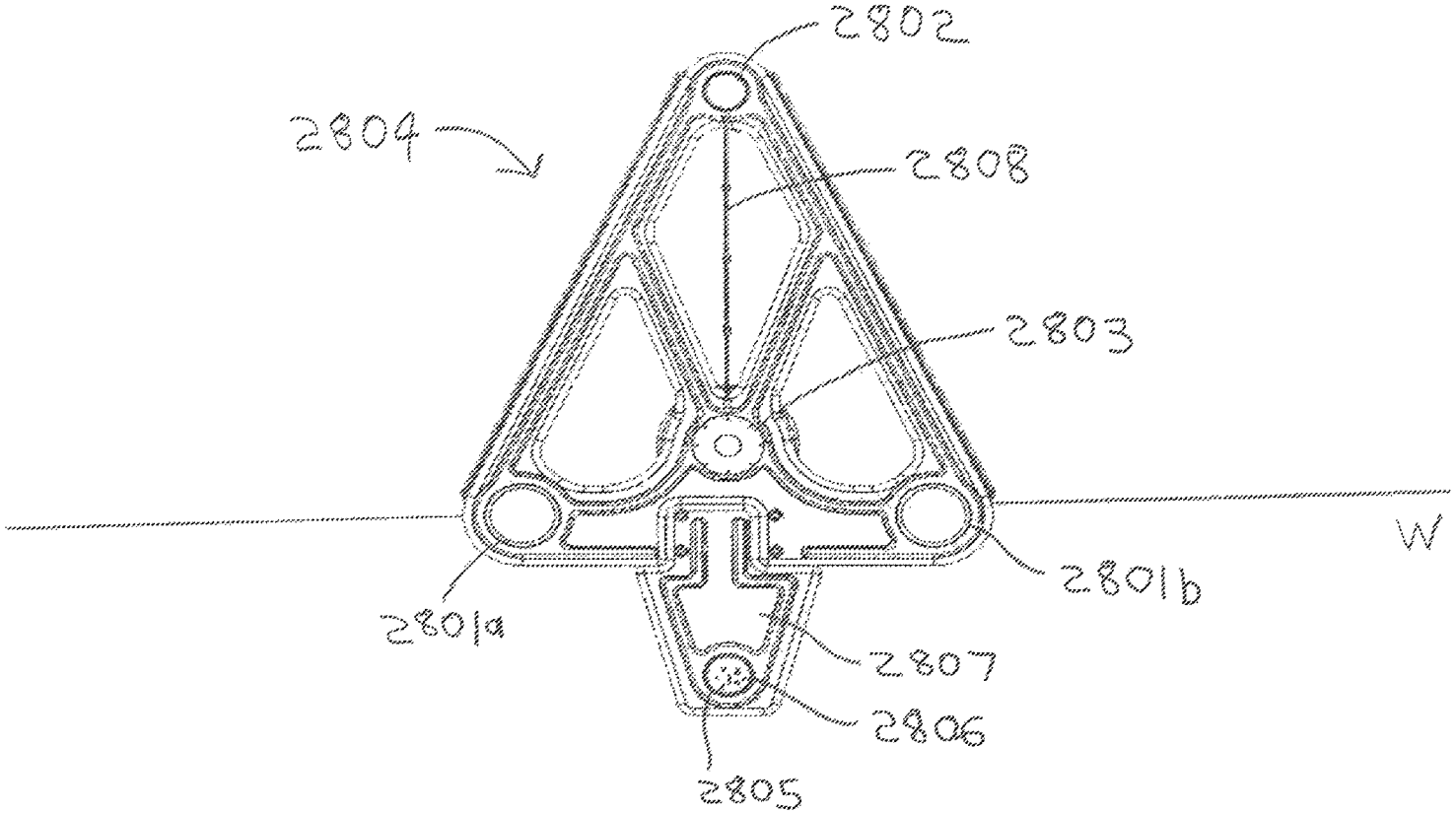
Figure 30A:
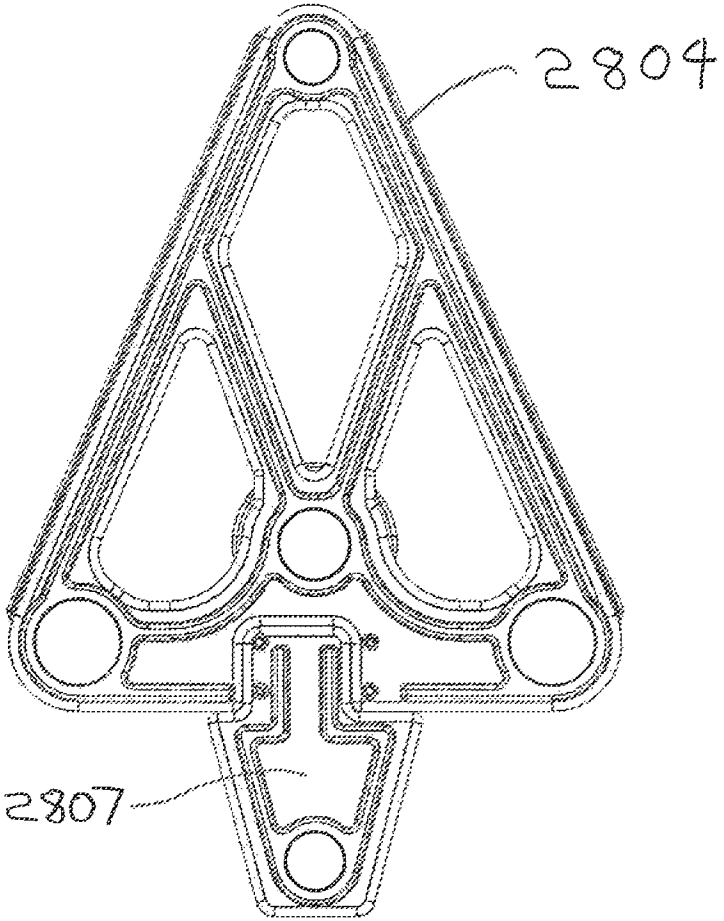
FIG. 30*a* is a front view of a truss of the barrier of FIG. 28.
Figure 30C:
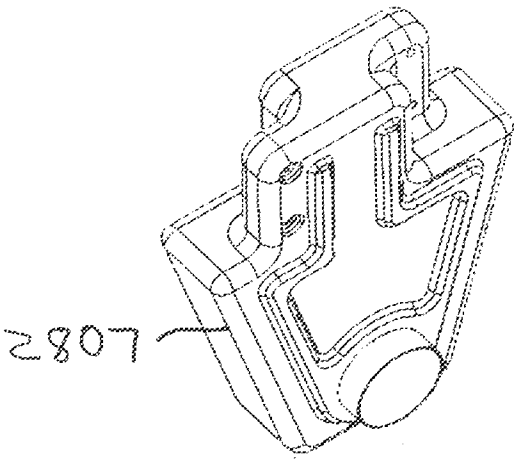
FIGS. 30*b-c* are a front view and a perspective view, respectively, of components of the truss of FIG. 30*a*.
Figure 30B:
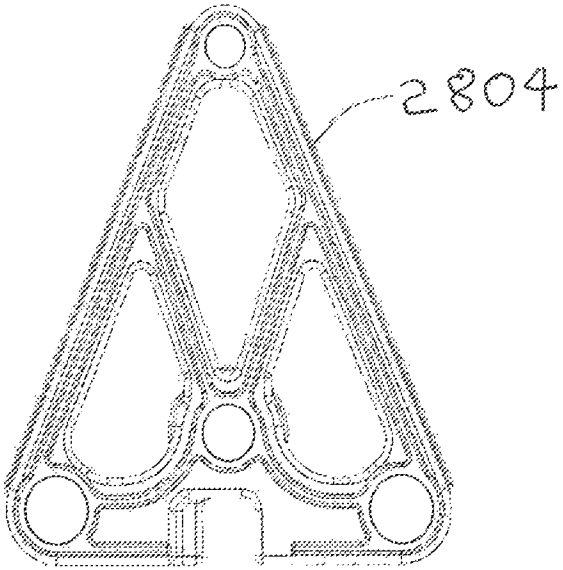

In further embodiments shown in FIGS. 24-30, marine barriers are disclosed having a configuration similar to previously-described embodiments, but employing a single primary load bearing member and a single primary load bearing hinge. Previously-described configurations employ two sets of load bearing members (the outer pipes referred to as buoyant members) and certain of those embodiments employ two corresponding hinges to connect barrier units. However, in this configuration, the barrier has an additional lateral structural member extending down the centerline of the unit, either at the water surface (FIGS. 24-27) or supported above the water surface (FIGS. 28-30).

The main load bearing member absorbs the environmental forces associated with impact and environmental events, and transfers the forces to successive barrier units. The addition of the main load bearing structural member also minimizes the forces within the truss components and outer buoyant members. This allows the pipes making up the buoyant members and the trusses to be reduced in diameter or wall thickness, depending upon deployment site-specific requirements.

The net attachment in such embodiments is similar or identical to that described previously. The barriers' stability and dynamic behavior is also similar to the barriers of the previously described embodiments. The single main load bearing member is held within a truss using similar techniques and construction methods as the other barrier components described in previous embodiments.

FIGS. 24-27 illustrate a marine barrier unit 2400 according to an embodiment of the disclosure having two substantially parallel elongate buoyant members 2401*a*, 2401*b* spaced apart from each other, such as foam-filled HDPE flotation pipes. An elongate net support member 2402 is spaced from the buoyant members 2401*a*, 2401*b*, and is disposed between the two buoyant members 2401*a*, 2401*b* and above the buoyant members when they are floating in a body of water W. In certain embodiments, the net support member 2402 is an HDPE pipe co-extruded to increase visibility; e.g., in alternating red and white colors. A single elongate main load bearing member 2403 is spaced from the buoyant members 2401*a, b* and disposed between the buoyant members. The material of the main load bearing member 2403 can be HDPE, pultruded composite using a resin such as vinylester, or galvanized steel. In the embodiment of FIGS. 24-27, the main load bearing member 2403 is disposed substantially at the waterline (see, FIG. 25*b*) when the buoyant members 2401*a, b* are floating in the body of water W. In other embodiments (e.g., as shown in FIGS. 28-30), the main load-bearing member is above the body of water W when the buoyant members are floating in the body of water W.

Figure 25A:
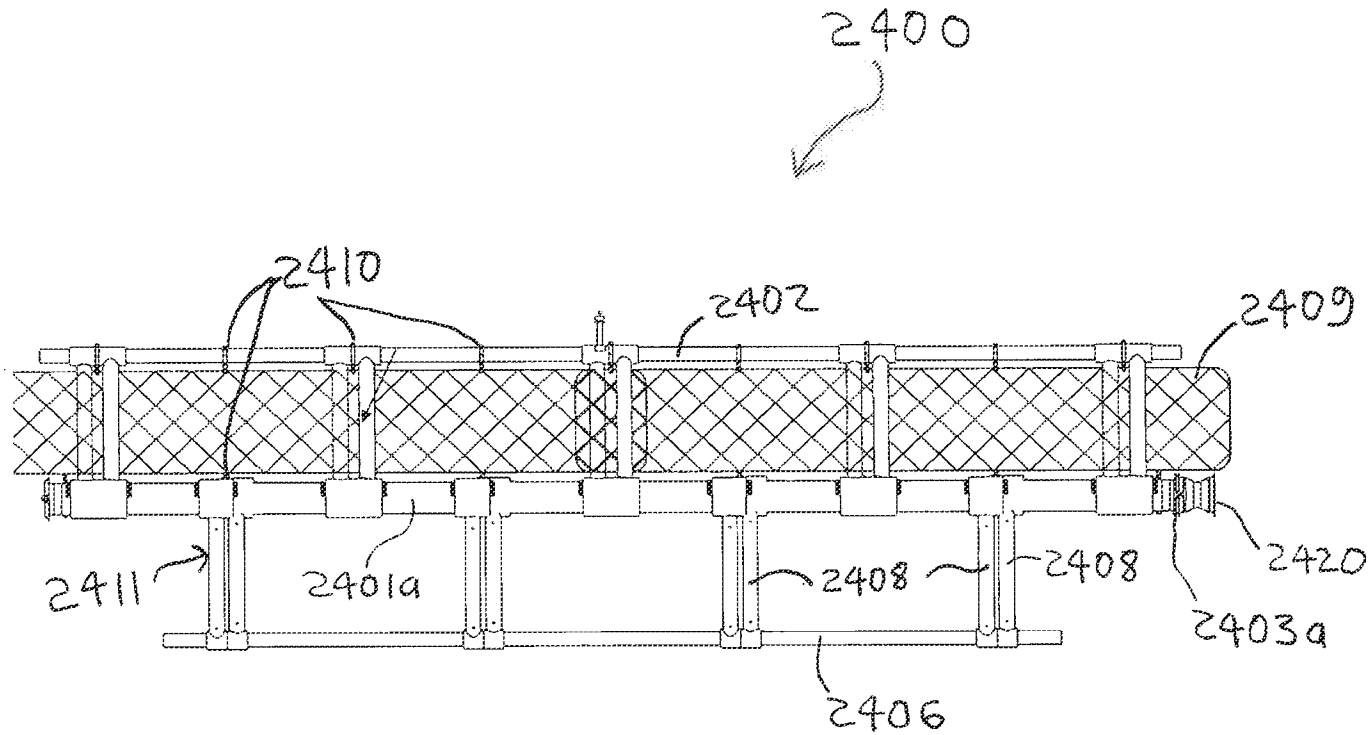
FIGS. 25*a-b* are a side view and an end view, respectively, of the barrier of FIG. 24.
Figure 25B:
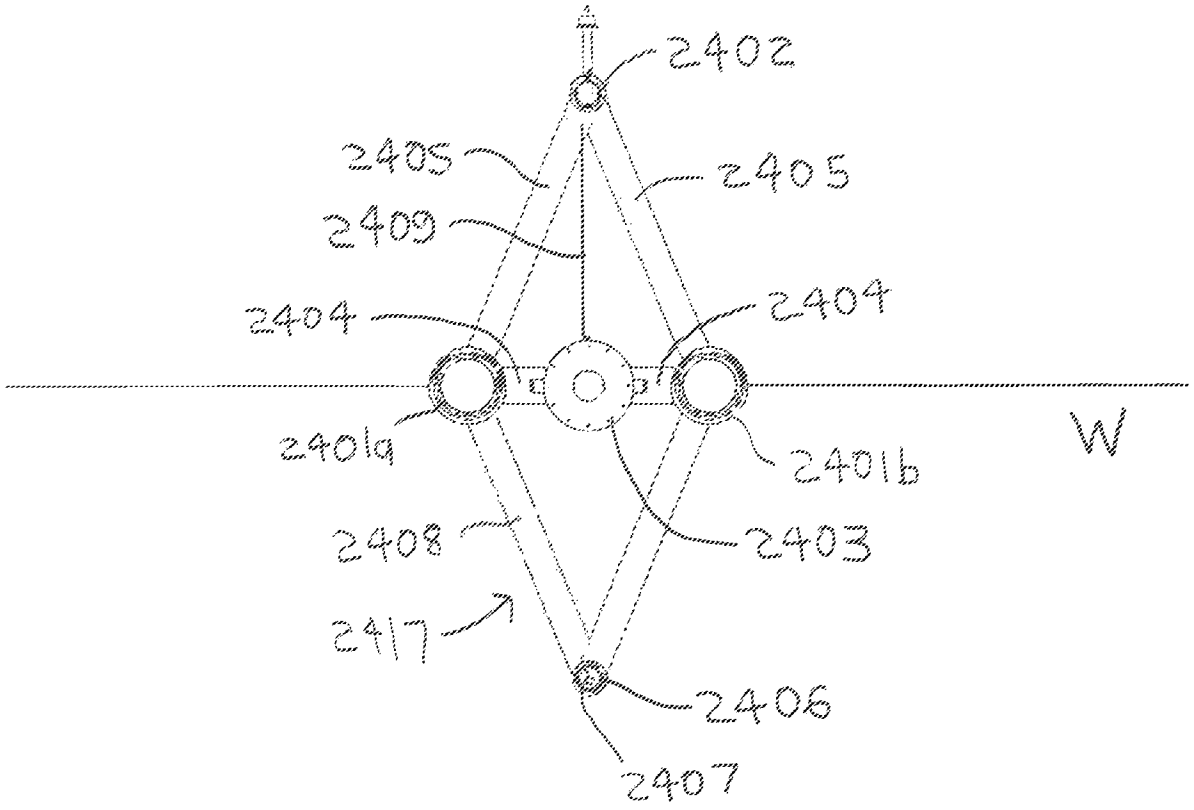

As best seen in FIGS. 25*b* and 27, a plurality of substantially rigid first stanchions 2404 each extend between one of the two buoyant members 2401*a, b* and the main load bearing member 2403 to maintain the spacing between the buoyant members 2401*a, b* and the main load bearing member 2403. A plurality of substantially rigid second stanchions 2405 each extend between one of the buoyant members 2401*a, b* and the net support member 2402 to maintain the spacing between the buoyant members 2401*a, b* and the net support member 2402. The first and second stanchions 2404, 2405 can comprise polymer tubes, such as HDPE tubes.

An elongate lower ballast member 2406 having ballast 2407 is spaced from the two buoyant members 2401*a, b* and the main load bearing member 2403, and is disposed between the buoyant members 2401*a,b* and below the buoyant members 2401*a, b* when the buoyant members 2401*a, b* are floating in the body of water W. A plurality of substantially rigid third stanchions 2408, such as HDPE pipe sections, each extend between one of the buoyant members 2401*a, b* and the lower ballast member 2406 to maintain the spacing between the buoyant members 2401*a, b* and the lower ballast member 2406. The ballast 2407 has sufficient weight to provide a restoring force to restore the barrier 2400 to an upright position when the buoyant members 2401*a, b* are floating in the body of water W and the barrier 2400 rotates from the upright position; in certain embodiments, when the barrier 2400 rotates up to 135 degrees from vertical. The dynamics of the barrier of this embodiment when it rotates from the upright position is similar to that of the barriers described in detail herein above with reference to FIGS. 3*a-c*.

An impact net 2409 is attached to the net support member 2402 and the main load bearing member 2403. As in previously-described embodiments, the impact net 2409 is comprised of metal rings, a metal rope, or a polymer net (e.g., conventional rockfall netting or stainless steel rings) and in certain embodiments is attached to the net support member 2402 and the main load bearing member 2403 using a plurality of pipe bands at net connection points 2410.

In certain embodiments, one of the plurality of first stanchions 2404 extending between a first one of the buoyant members 2401*a* and the main load bearing member 2403, another one of the first stanchions 2404 extending between a second one of the buoyant members 2401*b* and the main load bearing member 2403, one of the plurality of second stanchions 2405 extending between the first one of the buoyant members 2401*a* and the net support member 2402, and another one of the plurality of second stanchions 2405 extending between the second one of the buoyant members 2401*b* and the net support member 2402 are attached to each other to form a first truss 2411, as best seen in FIG. 27. The first truss 2411 has fittings 2412, 2413, 2414 joining adjacent stanchions of the first truss 2411 to each other, and is configured to connect the first and second buoyant members 2401*a, b*, the main load bearing member 2403, and the net support member 2402. As in certain previously-described embodiments, all parts of the first truss 2411 can be standard HDPE pipe sections fused together.

In certain embodiments, one of the plurality of third stanchions 2408 extending between the first one of the buoyant members 2401*a* and the lower ballast member 2406, and another one of the plurality of third stanchions 2408 extending between the second one of the buoyant members 2401*b* and the lower ballast member 2406 are attached to each other to form a second truss 2415. The second truss 2415 has a fitting 2416 joining adjacent stanchions of the second truss 2415 to each other, and is configured to connect the first and second buoyant members 2401*a, b* and the lower ballast member 2406. As in certain previously-described embodiments, all parts of the second truss 2415 can be standard HDPE pipe sections fused together.

Referring now to FIG. 25*b*, in certain embodiments, the first truss 2411 and the second truss 2415 are combined to form a third truss 2417 comprising one of the plurality of first stanchions 2404 extending between the first one of the buoyant members 2401*a* and the main load bearing member 2403, another one of the first stanchions 2404 extending between the second one of the buoyant members 2401*b* and the main load bearing member 2403, one of the plurality of second stanchions 2405 extending between the first one of the buoyant members 2401*a* and the net support member 2402, another one of the plurality of second stanchions 2405 extending between a second one of the buoyant members 2401*b* and the net support member 2402, one of the plurality of third stanchions 2408 extending between the first one of the buoyant members 2401*a* and the lower ballast member 2406, and another one of the plurality of third stanchions 2408 extending between the second one of the buoyant members 2401*b* and the lower ballast member 2406, with the fittings 2412-2414 and 2416 joining adjacent stanchions of the third truss to each other. Thus, the third truss 2417 connects the first and second buoyant members 2401*a, b*, the main load bearing member 2403, the net support member 2402, and the lower ballast member 2406.

The barrier unit 2400 of this embodiment is attachable to a substantially identical second barrier unit 2400 by flexibly attaching a first end 2403*a* of the main load bearing member 2403 to a corresponding first end 2403*a* of the main load bearing member 2403 of the second barrier 2400, as shown in FIG. 26. A single elastic hinge joint 2420 is attachable to the first end 2403*a* of the main load bearing member 2403 of barrier unit 2400 and attachable to the corresponding first end 2403*a* of the main load bearing member 2403 of the second barrier 2400. The elastic hinge joint is comparable to hinge 2110 of the embodiment of FIGS. 21-23*b*, and has similar characteristics.

When the buoyant members 2401*a, b* are floating in the body of water W and a moving vessel V impacts the impact net 2409, the impact net 2409 deflects to transfer a force of the impact to the net connection points 2410, net support member 2402, main load bearing member 2403, first truss 2411 (i.e., first stanchions 2404, second stanchions 2405, and fittings 2412-2414), second trusses 2415 (i.e., third stanchions 2408 and fittings 2416), buoyant members 2401*a,b* and lower ballast member 2407 (see arrows X, Y, and Z). The buoyant members 2401*a, b* and lower ballast member 2407 in turn engage the water W to transfer the force of the impact to the water W and arrest the motion of the vessel V as they drag through the water W, absorbing energy.

At this stage, events have reduced the vessel's initial kinetic energy by utilizing energy to damage the vessel itself; absorbing energy required to deform the impact net 2409; dissipating energy required to move/accelerate the barrier (i.e., barrier inertia) due to the barrier being pushed by the vessel; and dissipating energy required to accelerate the added mass of water around the barrier. The leftover energy/force is then passed through the central main load bearing member 2403, through the hinge 2420, to the next barrier unit 2400.

The environmental loading on the barrier unit 2400 follows the same general principles as above, except that the load will be due to wave and fluid drag, and buoyancy forces. The single main load bearing pipe member 2403 transmits the balance of applied loads versus absorbed/dissipated loads to the next barrier unit 2400 via single hinge 2420. This is in contrast to the barriers of previously disclosed embodiments of FIG. 19, etc. where the pair of buoyant members 101*a*, 101*b* and the pair of elastic hinge joints 700 perform these functions.

Thus, the barrier of FIGS. 24 through 27 is similar to previously-described embodiments, except that it employs a single main load bearing member 2403 that runs down the centerline of the barrier. At the ends of the main load bearing member 2403, a single hinge assembly 2420 is attached. This centerline load bearing assembly absorbs environmental and impact forces and transfers them to the water W and surrounding barrier units 2400. This barrier is otherwise similar to previously-described embodiments, except that the geometry of elastic hinge 2420 is altered as described in detail herein above to allow for additional flexibility in all directions.

A further embodiment of the disclosed marine barrier shown in FIGS. 28-30 is similar to the "single load bearing member, single hinge" barrier 2400 discussed immediately herein above, except that its first truss 2411 is fabricated integrally using rotomolded HDPE components, rather than welding separate pipe sections together to form first truss 2411. All the pipes that make up the buoyant members 2401*a, b*, net support member 2402, and main load bearing member 2403 slide through the rotomolded truss. Therefore, the primary duty of this component is "station-keeping" of the various components of the barrier. The rotomolded (or twin sheet formed) component can be foam-filled or filled with ballast materials, depending upon site specific requirements.

In certain embodiments, the rotomolded truss has a detachable ballast support member that can be added and removed via a bolted connection of the bottom of the truss. This configuration enables the barrier to be used in shallow water, or rest on tidal flats if required. The ballast support member is fabricated using similar methods and materials as the truss component.

Figure 24:
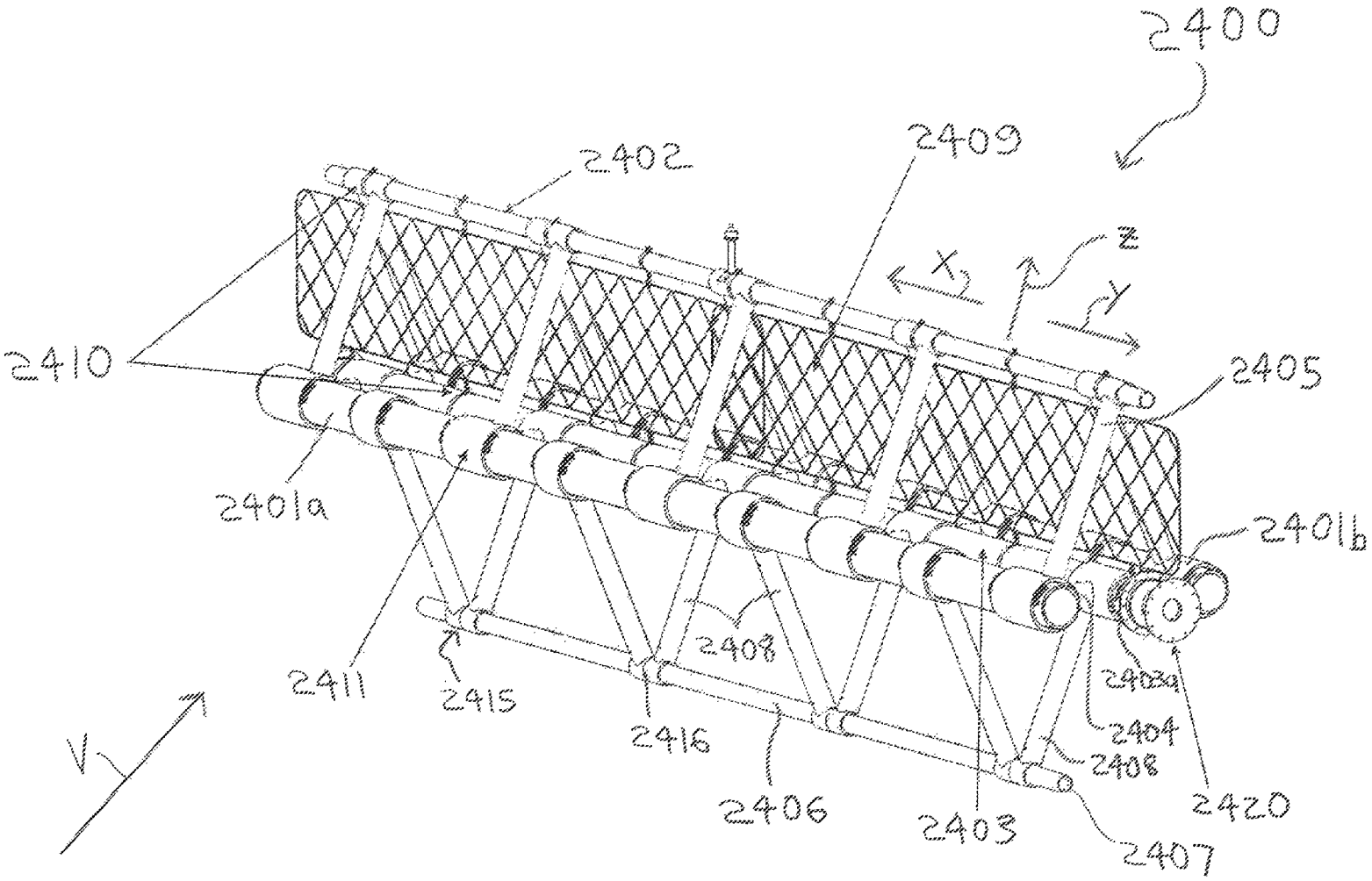
FIG. 24 is a perspective view of a marine barrier according to the present disclosure.

Referring now to FIGS. 28-30, a barrier unit 2800 comprises several components similar or identical to that of barrier unit 2400 of FIG. 24. In particular, two substantially parallel elongate buoyant members 2801*a*, 2801*b* are spaced apart from each other, such as foam-filled HDPE flotation pipes. An elongate net support member 2802 is spaced from the buoyant members 2401*a*, 2401*b*, and is disposed between the two buoyant members 2801*a*, 2801*b* and above the buoyant members when they are floating in a body of water W. In certain embodiments, the net support member 2802 is an HDPE pipe co-extruded to increase visibility; e.g., in alternating red and white colors. A single elongate main load bearing member 2803 is spaced from the buoyant members 2801*a, b* and disposed between the buoyant members. The material of the main load bearing member 2803 can be HDPE, pultruded composite using a resin such as vinylester, or galvanized steel. In this embodiment, the main load-bearing member 2803 is above the body of water W when the buoyant members 2801*a, b*, are floating in the body of water W. However, it should be understood that in alternative embodiments, the main load bearing member 2803 can be disposed substantially at the waterline (as shown in FIG. 25*b*) when the buoyant members 2801*a, b* are floating in the body of water W.

In this embodiment, the stanchions and fittings of the first truss 2411 shown in FIG. 27 are integrally formed with each other of a polymer such as HDPE to form a main truss 2804. The main truss 2804 is fabricated by conventional rotomolding in a single piece, or it may comprise a pair of polymer sheets joined together. The main truss 2804 has a hollow internal portion which in certain embodiments is filled with foam or with a ballast material, depending on site specific requirements.

The barrier unit further comprises, in certain embodiments, an elongate lower ballast member 2805 having ballast 2806, spaced from the two buoyant members 2801*a, b* and the main load bearing member 2803, and disposed between the buoyant members 2801*a, b* and below the buoyant members when they are floating in the body of water W. A substantially rigid ballast support member 2807 extends from each of the main trusses 2804 to the lower ballast member 2805 to maintain the spacing between the buoyant members 2801*a, b*, the main load bearing member 2803, and the lower ballast member 2805. Each of the ballast support members 2807 are removably attachable to a corresponding one of the main trusses 2804, and can be rotomolded similarly to the main trusses 2804. As in the previously-disclosed embodiments, the ballast 2806 has sufficient weight to provide a restoring force to restore the barrier 2800 to an upright position when the buoyant members 2801*a, b* are floating in the body of water W and the barrier rotates from the upright position. The dynamics of the barrier 2800 of this embodiment when it rotates from the upright position is similar to that of the barriers described in detail herein above with reference to FIGS. 3*a-c* and 24-27.

An impact net 2808 is attached to the net support member 2802 and the main load bearing member 2803. As in previously-described embodiments, the impact net 2808 is comprised of metal rings, a metal rope, or a polymer net (e.g., conventional rockfall netting or stainless steel rings) and in certain embodiments is attached to the net support member 2802 and the main load bearing member 2803 using a plurality of pipe bands at net connection points 2809.

The barrier unit 2800 of this embodiment is attachable to a substantially identical second barrier unit 2800 by flexibly attaching a first end 2803*a* of the main load bearing member 2803 to a corresponding first end of the main load bearing member of a second barrier 2800 (not shown), similarly to the barrier units 2400 shown in FIG. 26. A single elastic hinge joint 2810 is attachable to the first end 2803*a* of the main load bearing member 2803 of barrier unit 2800 and attachable to the corresponding first end of the main load bearing member of the second barrier 2800. The elastic hinge joint 2810 is comparable to hinge 2110 of the embodiment of FIGS. 21-23*b*, and to the hinge 2420 of the embodiment of FIGS. 24-27, and has similar characteristics. The load path and behavior of the barrier 2800 upon impact with a vessel is similar to that of barrier 2400 described herein above.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments.

Exemplary embodiments have been presented. The disclosure is not limited to these examples. These examples are presented herein for purposes of illustration, and not limitation. Alternatives (including equivalents, extensions, variations, deviations, etc., of those described herein) will be apparent to persons skilled in the relevant art(s) based on the teachings contained herein. Such alternatives fall within the scope and spirit of the disclosure.

What is claimed is:

1. A marine barrier comprising:

two substantially parallel elongate buoyant members spaced apart from each other;

an elongate net support member spaced from the buoyant members, disposed between the two buoyant members and above the buoyant members when the buoyant members are floating in a body of water;

a single elongate main load bearing member spaced from the buoyant members and disposed between the buoyant members;

a plurality of substantially rigid first stanchions, each extending between one of the two buoyant members and the main load bearing member to maintain the spacing between the buoyant members and the main load bearing member;

a plurality of substantially rigid second stanchions, each extending between one of the buoyant members and the net support member to maintain the spacing between the buoyant members and the net support member; and an impact net attached to the net support member and the main load bearing member, such that when the buoyant members are floating in the body of water and a moving vessel impacts the impact net, the impact net deflects to transfer a force of the impact to the net support member, the main load bearing member, the first stanchions, the second stanchions, and the buoyant members, and the buoyant members in turn engage the water to transfer the force of the impact to the water and arrest the motion of the vessel;

wherein one of the plurality of first stanchions extending between a first one of the buoyant members and the main load bearing member, another one of the first stanchions extending between a second one of the buoyant members and the main load bearing member, one of the plurality of second stanchions extending between the first one of the buoyant members and the net support member, and another one of the plurality of second stanchions extending between a second one of the buoyant members and the net support member are attached to each other to form a first truss, the first truss having fittings joining adjacent stanchions of the first truss to each other, the first truss configured to connect the first and second buoyant members, the main load bearing member, and the net support member.

2. The marine barrier of claim 1, further comprising an elongate lower ballast member having ballast, the lower ballast member spaced from the two buoyant members and the main load bearing member, the lower ballast member disposed between the buoyant members and below the buoyant members when the buoyant members are floating in the body of water; and a plurality of substantially rigid third stanchions, each extending between one of the buoyant members and the lower ballast member to maintain the spacing between the buoyant members and the lower ballast member;

wherein the ballast has sufficient weight to provide a restoring force to restore the barrier to an upright position when the buoyant members are floating in the body of water and the barrier rotates from the upright position.

3. The marine barrier of claim 2, wherein the ballast has sufficient weight to provide a restoring force to restore the barrier to the upright position when the buoyant members are floating in the body of water and the barrier rotates up to 135 degrees from vertical.

4. The marine barrier of claim 2, wherein one of the plurality of third stanchions extending between the first one of the buoyant members and the lower ballast member, and another one of the plurality of third stanchions extending between the second one of the buoyant members and the lower ballast member are attached to each other to form a second truss, the second truss having a fitting joining adjacent stanchions of the second truss to each other, the second truss configured to connect the first and second buoyant members and the lower ballast member.

5. The marine barrier of claim 4, wherein the first truss and the second truss are combined to form a third truss comprising one of the plurality of first stanchions extending between the first one of the buoyant members and the main load bearing member, another one of the first stanchions extending between the second one of the buoyant members and the main load bearing member, one of the plurality of second stanchions extending between the first one of the buoyant members and the net support member, another one of the plurality of second stanchions extending between a second one of the buoyant members and the net support member, one of the plurality of third stanchions extending between the first one of the buoyant members and the lower ballast member, and another one of the plurality of third stanchions extending between the second one of the buoyant members and the lower ballast member, the third truss having fittings joining adjacent stanchions of the third truss to each other, the third truss configured to connect the first and second buoyant members, the main load bearing member, the net support member, and the lower ballast member.

6. The marine barrier of claim 1, wherein the buoyant members comprise polymer tubes filled with a foam.

7. The marine barrier of claim 1, wherein the first and second pluralities of stanchions comprise polymer tubes.

8. The marine barrier of claim 1, wherein the main load bearing member comprises a polymer tube or a steel tube.

9. The marine barrier of claim 1, comprising a plurality of pipe bands for attaching the impact net to the net support member and the main load bearing member.

10. The marine barrier of claim 1, wherein the impact net comprises metal rings, a metal rope, or a polymer net.

11. The marine barrier of claim 1, wherein the main load bearing member is disposed above the body of water when the buoyant members are floating in the body of water, or substantially at a waterline when the buoyant members are floating in the body of water.

12. The marine barrier of claim 1, wherein the barrier is attachable to a second barrier substantially identical to the barrier by flexibly attaching a first end of the main load bearing member to a corresponding first end of the main load bearing member of the second barrier;

the barrier further comprising an elastic hinge joint attachable to the first end of the main load bearing member and attachable to the corresponding first end of the main load bearing member of the second barrier.

13. The marine barrier of claim 1, wherein the stanchions and fittings of the first truss are integrally formed with each other and comprise a hollow portion.

14. The marine barrier of claim 13, wherein the hollow portion of the first truss is filled with foam or with a ballast material.

15. The marine barrier of claim 13, wherein the stanchions and fittings of the first truss comprise a single-piece polymer molding or a pair of polymer sheets joined together.

16. The marine barrier of claim 13, further comprising an elongate lower ballast member having ballast, the lower ballast member spaced from the two buoyant members and the main load bearing member, the lower ballast member disposed between the buoyant members and below the buoyant members when the buoyant members are floating in the body of water; and a plurality of substantially rigid ballast support members, each extending from one of the first trusses to the lower ballast member to maintain the spacing between the buoyant members and the lower ballast member;

wherein each of the ballast support members are removably attachable to a corresponding one of the first trusses; and wherein the ballast has sufficient weight to provide a restoring force to restore the barrier to an upright position when the buoyant members are floating in the body of water and the barrier rotates from the upright position.

17. A marine barrier comprising:

two substantially parallel elongate buoyant members spaced apart from each other;

an elongate net support member spaced from the buoyant members, disposed between the two buoyant members and above the buoyant members when the buoyant members are floating in a body of water;

a plurality of substantially rigid first stanchions extending between the two buoyant members to maintain the spacing between the buoyant members;

a plurality of substantially rigid second stanchions, each extending between one of the buoyant members and the net support member to maintain the spacing between the buoyant members and the net support member; and an impact net attached to the net support member and a first one of the buoyant members, or to the net support member and the plurality of first stanchions, such that when the buoyant members are floating in the body of water and a moving vessel impacts the impact net, the impact net deflects to transfer a force of the impact to one or more of the net support member, the first stanchions, the second stanchions, and the buoyant members, and the buoyant members in turn engage the water to transfer the force of the impact to the water and arrest the motion of the vessel;

wherein one of the plurality of first stanchions, one of the plurality of second stanchions extending between the first one of the buoyant members and the net support member, and another one of the plurality of second stanchions extending between a second one of the buoyant members and the net support member are attached to each other to form a truss, the truss having fittings joining adjacent stanchions of the truss to each other, the truss configured to connect the first and second buoyant members and the net support member;

wherein the barrier is attachable to a second barrier substantially identical to the barrier by flexibly attaching a first end of the barrier to a corresponding first end of the second barrier;

wherein the barrier comprises an elastic hinge joint and a hinge adapter at the barrier first end, the hinge adapter rigidly attachable to the net support member and the buoyant members, and also attachable to the elastic hinge joint;

wherein the elastic hinge joint is further attachable to the corresponding hinge adapter of the second barrier.

* * * * *